US007021981B2

(12) United States Patent
Onishi et al.

(10) Patent No.: US 7,021,981 B2
(45) Date of Patent: Apr. 4, 2006

(54) METHOD FOR MANUFACTURING ELECTRON EMISSION ELEMENT, ELECTRON SOURCE, AND IMAGE FORMING APPARATUS

(75) Inventors: Toshikazu Onishi, Kanagawa-ken (JP); Yoshikazu Banno, Tokyo (JP); Michiyo Nishimura, Kanagawa-ken (JP); Toshihiko Takeda, Kanagawa-ken (JP); Keisuke Yamamoto, Kanagawa-ken (JP); Tomoko Maruyama, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 140 days.

(21) Appl. No.: 10/014,131

(22) Filed: Dec. 13, 2001

(65) Prior Publication Data

US 2002/0068496 A1 Jun. 6, 2002

Related U.S. Application Data

(62) Division of application No. 09/848,360, filed on May 4, 2001, now Pat. No. 6,379,211, which is a division of application No. 09/248,102, filed on Feb. 11, 1999, now Pat. No. 6,267,636.

(30) Foreign Application Priority Data

Feb. 12, 1998 (JP) ..... 10-029538

(51) Int. Cl.
*H01J 9/00* (2006.01)
*H01J 9/02* (2006.01)

(52) U.S. Cl. ..... 445/6; 445/50
(58) Field of Classification Search ..... 445/6
See application file for complete search history.

(56) References Cited

U.S. PATENT DOCUMENTS

| | | | | |
|---|---|---|---|---|
| 4,904,895 | A | 2/1990 | Tsukamoto et al. | 313/336 |
| 5,066,883 | A | 11/1991 | Yoshioka et al. | 313/309 |
| 5,591,061 | A * | 1/1997 | Ikeda et al. | 445/3 |
| 5,605,483 | A | 2/1997 | Takeda et al. | 445/2 |
| 5,650,795 | A | 7/1997 | Banno et al. | 345/74 |
| 5,719,027 | A | 2/1998 | Miyazaki et al. | 435/6 |
| 5,735,920 | A | 4/1998 | Omori et al. | 65/29.18 |
| 5,749,763 | A | 5/1998 | Yoshioka et al. | 445/51 |
| 5,853,310 | A * | 12/1998 | Nishimura et al. | 445/24 |
| 5,998,924 | A * | 12/1999 | Yamamoto et al. | 445/38 |
| 6,005,333 | A | 12/1999 | Kaneko et al. | 313/306 |
| 6,008,569 | A * | 12/1999 | Yamanobe | 313/310 |

(Continued)

FOREIGN PATENT DOCUMENTS

EP 0 660 357 A1 6/1995

(Continued)

OTHER PUBLICATIONS

W.P. Dyke, et al., "Field Emission", Advances in Electronics and Electron Physics, vol. VIII, pp. 89-185, 1956.

(Continued)

*Primary Examiner*—Mariceli Santiago
(74) *Attorney, Agent, or Firm*—Fitzpatrick, Cella, Harper & Scinto

(57) ABSTRACT

A method for manufacturing an electron emission element comprising, between its electrodes, a conductive film having an electron emission section. The method comprising the steps of forming a gap in the conductive film located between the electrodes, and applying a voltage between the electrodes in an atmosphere that has an aromatic compound with a polarity or a polar group and in which the partial pressure ratio of water to the aromatic compound is 100 or less.

8 Claims, 24 Drawing Sheets

U.S. PATENT DOCUMENTS

| | | | | |
|---|---|---|---|---|
| 6,147,449 | A | 11/2000 | Iwasaki et al. | 313/495 |
| 6,169,356 | B1 | 1/2001 | Ohnishi et al. | 313/495 |
| 6,171,162 | B1 | 1/2001 | Iwasaki et al. | 445/6 |
| 6,184,610 | B1 | 2/2001 | Shibata et al. | 313/309 |
| 6,221,426 | B1 | 4/2001 | Yamanobe | 427/77 |
| 6,309,272 | B1 | 10/2001 | Nishimura | 445/25 |
| 6,313,815 | B1 | 11/2001 | Takeda et al. | 345/75.2 |
| 6,582,268 | B1 | 6/2003 | Jindai et al. | 445/6 |
| 6,614,167 | B1 | 9/2003 | Ono et al. | 313/495 |

FOREIGN PATENT DOCUMENTS

| | | | |
|---|---|---|---|
| EP | 788130 | * | 6/1997 |
| EP | 0 805 472 A1 | | 11/1997 |
| JP | 64-31332 | | 2/1989 |
| JP | 8-7749 | | 1/1996 |
| JP | 8-334124 | | 12/1996 |
| JP | 9-237571 | | 9/1997 |
| JP | 10-188778 | * | 7/1998 |

OTHER PUBLICATIONS

C.A. Spindt et al., "Physical properties of thin-film field emission cathodes with molybdenum cones", J. Appl. Phys., vol. 47, No. 12, pp. 5248-5263, 1976.

C.A. Mead, "Operation of Tunnel-Emission Devices", J. Appl. Phys., vol. 32, No. 4, pp. 646-652, 1961.

M.L. Elinson, "The emission of hot electrons and the field emission of electrons from tin oxide", Radio Engineering and Electron Physics, pp. 1290-1296, 1965.

"Experimental Physics Lesson 14, Surface and Fine Grains", (ed., Koreo Kinoshita, Kyoritsu Shuppan, published on Sep. 1, 1986).

"Ultra Fine Particles—Creative-science and technology", (ed., Chikara Hayashi, Ryoji Ueda, and Akira Tasaki, Mita Shuppan, published 1988).

* cited by examiner

MONOPOLE ELECTRODE

QUADRUPOLE ELECTRODE

METHOD FOR MANUFACTURING ELECTRON EMISSION ELEMENT, ELECTRON SOURCE, AND IMAGE FORMING APPARATUS

This application is a division of U.S. patent application Ser. No. 09/848,360, filed May 4, 2001, now U.S. Pat. No. 6,379,211, issued Apr. 30, 2002, which is a division of U.S. patent application Ser. No. 09/248,102, filed Feb. 11, 1999, now U.S. Pat. No. 6,267,636, issued Jul. 31, 2001.

BACKGROUND OF THE INVENTION

1. Field of the Invention

The present invention relates to a method for manufacturing an electron emission element, an electron source having a plurality of the electron emission elements arranged therein, and an image forming apparatus such as a display that is configured using the electron source.

2. Related Background Art

Known electron-emission elements are roughly classified into two types: thermionic-emission elements and cold-emission elements. Cold-emission elements include a field emission type (hereafter referred to as an "FE" type), a metal/insulating layer/metal type (hereafter referred to as an "MIM" type), and surface conduction electron emission elements.

An example of the FE type is disclosed in W. P. Dyke and W. W. Dolan, "Field Emission", Advances in Electronics and Electron Physics, 8, 89 (1956) or C. A. Spindt, "Physical Properties of Thin-Film Field Emission Cathodes with Molybdenum Cones", J. Appl. Phys., 47, 5248 (1976).

An example of the MIM type is disclosed in C. A. Mead, "Operation of Tunnel-Emission Devices", J. Appl. Phys., 32, 646 (1961).

An example of the surface conduction electron emission elements is disclosed in M. I. Elinson, "The Emission of Hot Electrons and the Field Emission of Electrons from Tin Oxide", Radio Eng. and Electron Phys., 10, 1290 (1965).

The surface conduction electron emission element uses a phenomenon in which electron emission occurs when a current flows through a thin and small film formed on an insulating substrate, parallel with the film surface. In a typical example of a configuration of the surface conduction electron emission element, conduction processing called forming and subsequent activation are used to form an electron emission section in a conductive thin film that links a pair of element electrodes provided on an insulating substrate.

The forming is accomplished by applying a voltage to both ends of the thin film used to form the electron emission section to locally destroy, deform, or modify this film in order to form a crack having a high electric resistance.

The activation is accomplished by applying a voltage to both ends of the thin film in a vacuum atmosphere having an organic compound to form a carbon film near the crack. Electrons are emitted from near the crack.

Since the surface conduction electron emission element has a simple structure and is easy to manufacture, a large number of such elements are arranged over a large area. Thus, various applications have been researched to utilize this characteristic. This element has been applied to, for example, charging beam sources or image forming apparatuses such as displays.

An example of an arrangement of a large number of surface conduction electron emission elements is an electron source in which such elements are arranged in parallel in such a way that a large number of rows are formed by connecting both ends of the individual elements (for example, Japanese Patent Application Laid-Open No. 1-031332 specification of the applicant).

In particular, for image forming apparatuses such as displays, planar displays using liquid crystals have become popular in recent years in place of CRTs. Disadvantageously, these displays do not emit light spontaneously, they must have a back light. Thus, the development of displays that emit light spontaneously has been desired. An image forming apparatus that is a display comprising a combination of an electron source having a large number of surface conduction electron emission elements arranged therein and a fluorescent body that emits visible radiation using electrons emitted from the electron source is an excellent spontaneously-light-emitting display that is relatively easy to manufacture even with a large screen and that has a high display grade (for example, U.S. Pat. No. 5,066,883 specification of the applicant).

For electron emission elements used for the electron source or the image forming apparatus, the further provision of a stable controlled electron emission characteristic and the improvement of electron emission efficiency are desired in order to provide bright display images stably.

For image forming apparatuses using a fluorescent body as an image forming member, such apparatuses using a low current and forming bright high-grade images, for example, flat televisions, are obtained by providing a stable controlled electron emission characteristic and further improving electron emission efficiency. The use of a low current is also expected to reduce the cost of a driving circuit constituting the image forming apparatus.

SUMMARY OF THE INVENTION

It is an object of this invention to provide a method for manufacturing an electron emission element having a high electron emission efficiency, and an electron source and an image forming apparatus using such electron emission element.

It is another object of this invention to provide a method for manufacturing an electron emission element that is subject to very few temporal changes in electron emission characteristics induced by driving, and an electron source and an image forming apparatus using such electron emission element.

It is yet another object of this invention to provide a method for manufacturing an electron emission element that is subject to only a very small temporal decrease in emission current induced by driving, and an electron source and an image forming apparatus using such electron emission element.

DESCRIPTION OF THE PREFERRED EMBODIMENTS

Desirably, after the execution of activation to form a carbon film near a crack formed in a conductive film used to form an electron emission section, organic materials and their decomposed products have been removed so as to prevent the further unwanted deposition of carbons or carbon compounds. To achieve this, for example, electron emission elements are heated in a vacuum environment. This process, however, may remove part of the carbon film to preclude a desired amount of electrons emitted from being obtained.

Through enthusiastic research on this phenomenon, the inventors have found that the crystallinity of the carbon film is very important. That is, this phenomenon does not occur if the carbon film contains a large amount of crystalline carbons such as graphite, whereas it is likely to occur if the film contains a large amount of amorphous carbons with hydrogen.

The inventor's research has found that the presence of water (its partial pressure) in an atmosphere for an activation process closely correlates to a decrease in the electron emission amount or efficiency of electron emission elements obtained as well as temporal degradation during driving. That is, if besides organic substances, a large amount of water is present in the atmosphere for an activation process, the water may hinder the carbon film from being formed or reduce the crystallinity of the film.

Next, preferred embodiments of this invention will be shown.

First, basic configurations of electron emission elements manufactured using the present manufacturing method are roughly classified into a planar and a vertical types. The planar electron emission element will be described.

Figure 1A:
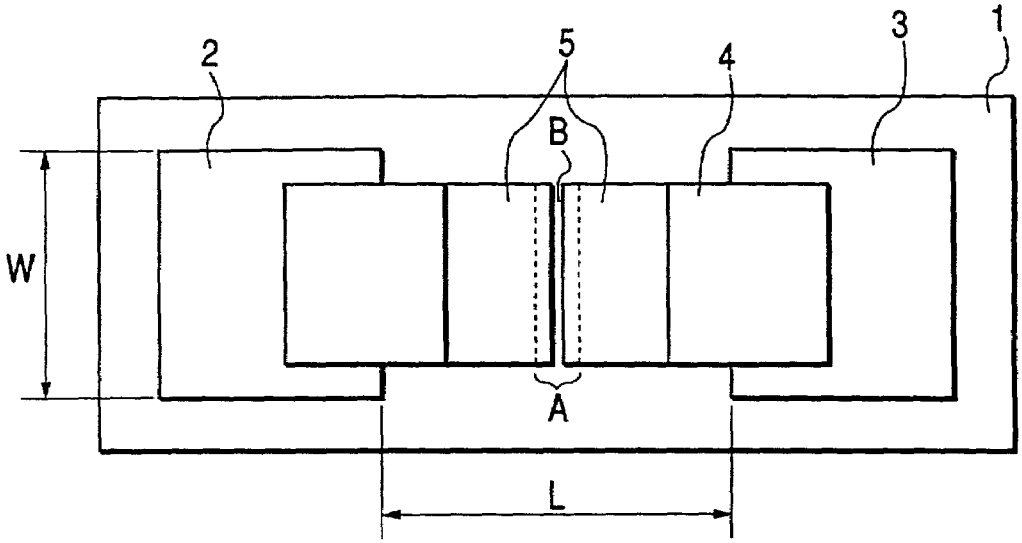
FIGS. 1A and 1B are a pictorial plan and sectional view showing an example of a configuration of a planar surface conduction electron emission element according to this invention.
Figure 1B:
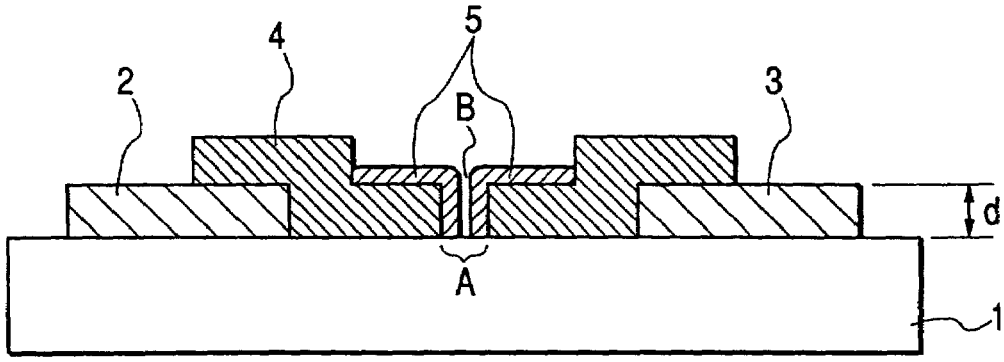

FIGS. 1A and 1B are image drawings showing an example of a configuration of a planar electron emission element manufactured using the present manufacturing method. FIG. 1A is a plan view, and FIG. 1B is a longitudinal sectional view. In FIGS. 1A and 1B, 1 is a substrate, 2 and 3 are electrodes (element electrode), 4 is a conductive film, and 5 is carbon film. The carbon film 5 is located inside of the gap A between the conductive films 4 to form a gap B narrower than the gap A as shown in the figure.

The substrate 1 comprises quartz glass, glass containing a reduced amount of impurities such as Na, blue plate glass, a glass substrate formed by laminating $SiO_2$ using the sputtering method, or a substrate of ceramics such as alumina or of Si.

The opposed element electrodes 2 and 3 may comprise a general conductive material that is selected as appropriate from, for example, a printed conductor composed of glass and a metal or alloy such as Ni, Cr, Au, Mo, W, Pt, Ti, Al, Cu, or Pd and a metal or metal oxide such as Pd, Ag, Au, $RuO_2$, or Pd—Ag; a transparent conductor such as $In_2O_3$—$SnO_2$; and a semiconductor material such as polysilicon.

An element electrode interval L, an element electrode length W, and the shape of the conductive film 4 are designed taking into account a form to which this element is applied. The element electrode interval L is preferably between several hundred nm and several hundred μm, more preferably between several μm and several tens μm. The element electrode length W may be between several μm and several hundred μm in view of the resistance value and electron emission characteristic of the electrode. The film thickness d of the element electrodes 2 and 3 may be between several tens nm and several μm.

Possible configurations include not only the one shown in FIGS. 1A and 1B but also one comprising the conductive film 4 and the opposed element electrodes 2 and 3 laminated on the substrate 1 in this order. A material mainly constituting the conductive film 4 may be selected as appropriate from a metal such as Pd, Pt, Ru, Ag, Au, Ti, In, Cu, Cr, Fe, Zn, Sn, Ta, W, or Pb, an oxide such as PdO, $SnO_2$, $In_2O_3$, PbO, or $Sb_2O_3$, a boride such as $HfB_2$, $ZrB_2$, $LaB_6$, $CeB_6$, $YB_4$, or $GdB_4$, a carbide such as TiC, ZrC, HfC, TaC, SiC, or WC, a nitride such as TiN, ZrN, or HfN, a semiconductor such as Si or Ge, or carbon.

The conductive film 4 may comprise a fine-particle film composed of fine particles in order to obtain an excellent electron emission characteristic. The film thickness is set as appropriate taking into account a process coverage for the element electrodes 2 and 3, the resistance value between the element electrodes 2 and 3, and forming conditions, which are described below. It is preferably between several angstrom units and several hundred nm, more preferably between 1 and 50 nm. The resistance value Rs is preferably between $10^2$ and $^-10^7$ Ω/□. Rs is a value obtained when the resistance R measured in the longitudinal direction of a thin film of width w and length 1 is assumed to be Rs (1/w).

The term "fine particles" is frequently used herein, so its meaning will be described.

Small particles are called "fine particles", and smaller particles are called "ultra fine particles". Much smaller particles having several hundred or less atoms are commonly called "clusters".

This definition, however, is not so strict and varies depending on a characteristic to be noted for classification. In some cases, "fine particles" and "ultra fine particles" are collectively called "fine particles", the description herein is based on this definition.

For example, "Experimental Physics Lesson 14, Surface and Fine Grains" (edited by Koreo KINOSHITA, Kyoritsu Shuppan, published on Sep. 1, 1986) states that "the fine particles" as used herein have a diameter between about 2 to 3 μm and about 10 nm, and the "ultra fine particles" as used herein have a diameter between about 10 nm and about 2 to 3 nm. In some cases, however, both types are collectively and simply called "fine particles", so this definition is not so strict but is only a rough standard. Fine particles each composed of about several 10 to 100 atoms are called "clusters" (pp. 195, lines 22 to 26).

In addition, in the definition of "ultra fine particles" in the "Hayashi Ultra Fine Particles Project" by the New-technology Development Work Organization, the lower limit of the particle size is much smaller as follows.

In the Ultra-fine Particles Project (1981 to 1986) by the Creative-science and -technology Promotion Institute they determined to call particles having a particle size between about 1 and 100 nm as "ultra fine particles". Then, a single ultra fine particle is a set of about 100 to about $10^8$ atoms. In terms of atoms, ultra fine particles are big as compared to "macro particles" ("Ultra Fine Particles—Creative-science and -technology" edited by Chikara HAYASHI, Ryoji UEDA, and Akira TASAKI; Mita Shuppan; 1988, pp. 2, lines 1 to 4). "A single grains smaller than the ultra fine grain that is composed of several to several hundred atoms is called a "cluster" (ibid., pp. 2, lines 12 to 13).

Based on these general definitions, the term "fine particles" as used herein refers to a set of a large number of atoms and molecules, wherein the lower limit of the particle size is between about several angstrom units and about 1 nm, while the upper limit is about several μm.

In addition, the carbon film 5 comprises carbons or carbon compounds, and its film thickness is preferably 50 nm or less, more preferably 30 nm or less.

The planar electron emission element described above is a surface conduction electron emission element, and a predetermined voltage is applied between the element electrodes 2 and 3 to allow electrons to be emitted from near the gap B.

Next, a vertical electron emission element will be described.

Figure 2:
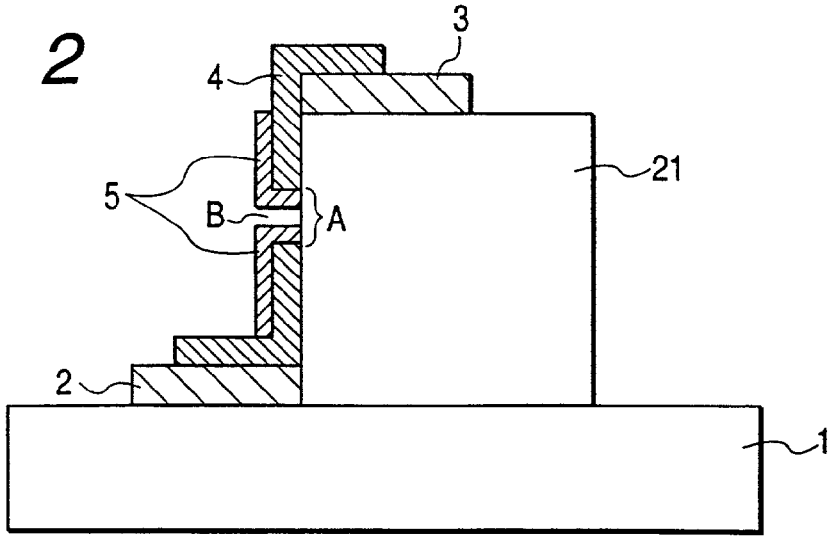
FIG. 2 is a sectional view showing an example of a configuration of a vertical surface conduction electron emission element according to this invention.

FIG. 2 is an image drawing showing an example of a configuration of a vertical electron emission element that has been manufactured according to this invention. The same sites as in FIGS. 1A and 1B have the same reference numerals as in this figure. Reference numeral 21 designates a process formation portion. The substrate 1, the element electrodes 2 and 3, the conductive film 4, and the carbon film 5 can each be composed of the same material as in the planar electron emission element. The process formation portion 21 can be composed of an insulating material such as $SiO_2$ using the vacuum evaporation method, the printing method, or the sputtering method.

The film thickness of the stage formation portion 21 corresponds to the element electrode interval L between the planar electron emission electrodes and may be between several hundred nm and several tens μm.

After the formation of the electron electrodes 2 and 3 and the process formation portion 21, the conductive film 4 is laminated on the electrodes 2 and 3. The carbon film 5 is located inside of the gap A between the conductive films 4 to form the gap B narrower than the gap A as shown in the figure.

The vertical electron emission element described above is also a surface conduction electron emission element, and a predetermined voltage is applied between the element electrodes 2 and 3 to allow electrons to be emitted from near the gap B.

Various methods can be used to manufacture the electron emission element according to this invention. An example of such a method will be described with reference to FIGS. 3A to 3D. In this figure, the same sites in FIGS. 1A and 1B have the same reference numerals as in the latter figure.

1) Formation of the Element Electrodes

Figure 3A:
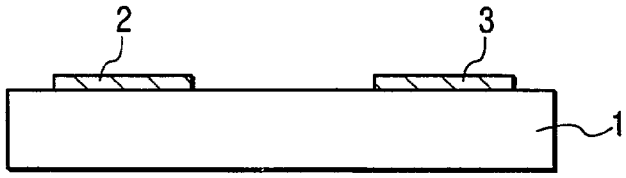
FIGS. 3A, 3B, 3C and 3D are process drawings describing a method for manufacturing an electron emission element according to this invention.

The substrate 1 is sufficiently washed using cleansing solvent, pure water and an organic solvent, the element electrode material is deposited on the substrate 1 using the vacuum evaporation method or the sputtering method, and the element electrodes 2 and 3 are formed on the substrate 1 using, for example, the photolithography technique (FIG. 3A).

2) Formation of the Conductive Film

Figure 3B:
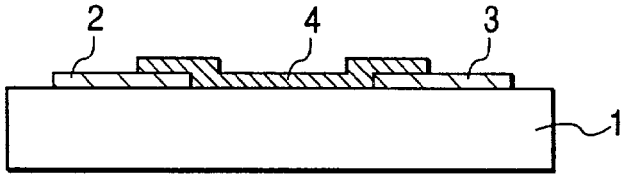

An organic-metal solution is applied to the substrate 1 with the element electrodes 2 and 3 provided thereon to form an organic-metal film. The organic-metal solution may be a solution of an organic compound comprising as a main element the metal used as the material of the conductive film. This organic-metal film is heated and baked and is then patterned by means of liftoff or etching to form the conductive film 4 (FIG. 3B). Although the method for applying the organic-metal solution has been described as an example, the formation of the conductive film 4 is not limited to it and the vacuum evaporation method, the sputtering method, the chemical vapor phase deposition method, the dispersive-coating method, the dipping method, or the spinner method can be used.

3) Forming Processing

Figure 3C:
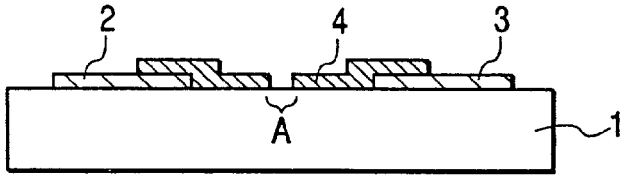
Figure 3D:
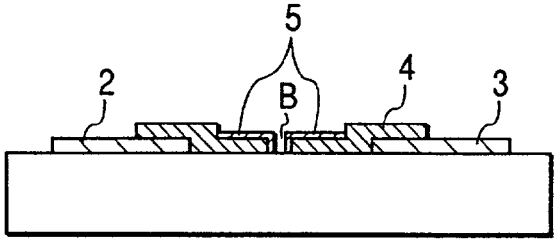

Subsequently, a forming process is executed. As an example of a method using this forming process, the conduction processing method will be described. When power from a power supply (not shown) is applied between the element electrodes 2 and 3 in a predetermined vacuum atmosphere, the gap A is formed at the site of the conductive film 4 (FIG. 3C). The conductive forming locally forms a crack in the conductive film 4. A voltage is applied via the element electrodes 2 and 3 to the conductive film 4 with the crack formed therein by the conductive forming, thereby allowing electrons to be emitted therefrom.

Figure 4A:
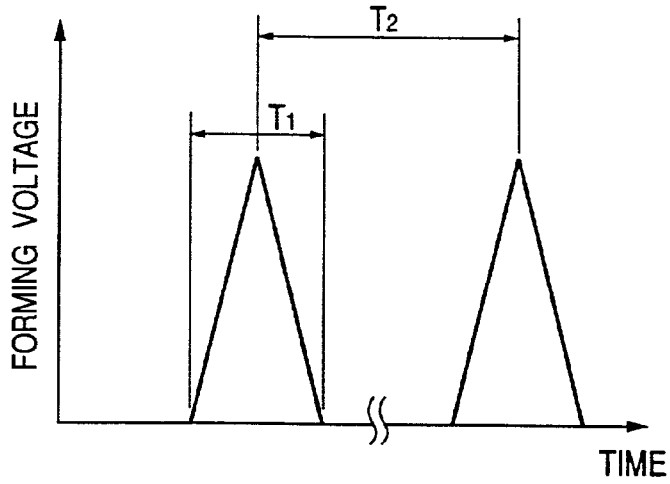
FIGS. 4A, 4B and 4C show examples of voltage waveforms for conductive forming according to this invention.
Figure 4B:
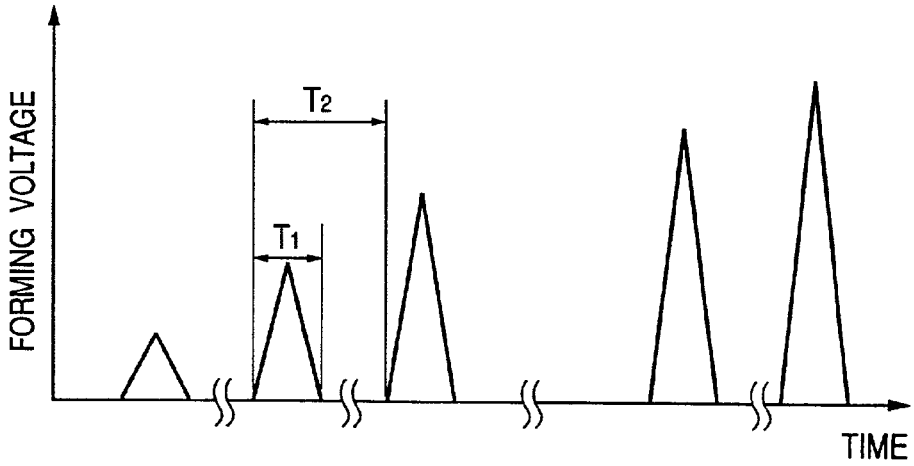

In particular, a voltage waveform for the conductive forming is preferably a pulse. A pulse having a peak value set as a constant voltage may be continuously applied as shown in FIG. 4A, or a pulse may be applied while increasing its peak value as shown in FIG. 4B.

The method of using a peak value set as a constant value will be described. In FIG. 4A, $T_1$ and $T_2$ are the pulse width and interval of a voltage waveform.

Figure 4C:
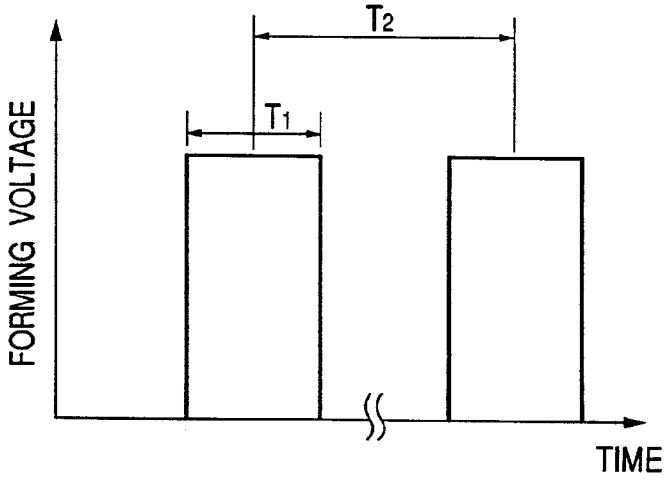

Normally, $T_1$ is set between 1 μsec. and 10 msec. and $T_2$ is set between 10 μsec. and 100 msec. The peak value of a chopping wave (a peak voltage during the conductive forming) is selected as appropriate depending on the form of the electron emission element. Under these conditions, a voltage is applied, for example, for several seconds to several tens of minutes. The pulse waveform is not limited to the chopping wave, and a desired waveform such as a rectangular one such as that shown in FIG. 4C may be employed.

Next, the method of applying a pulse while increasing its peak value will be explained. In FIG. 4B, $T_1$ and $T_2$ are similar to those shown in FIG. 4A. The peak value of the chopping wave (the peak value during the conductive forming) can be increased by, for example, a 0.1-V process.

The end of the conductive forming can be determined by applying a low voltage during a pulse pause period and measuring a current to detect a resistance value. For example, an element current that flows when a voltage of about 0.1 V is applied is measured to determine a resistance value, and when the resistance is determined to be 1 MΩ or more, the conductive forming is ended.

4) Activation

An activation process is executed for the elements for which the forming has been finished. The activation process increases an emission current $I_e$.

The activation process can be carried out by, for example, repeating applications of a pulse voltage between the element electrodes 2 and 3 in, for example, an atmosphere containing a gas of an organic substance, as in the conductive forming. This atmosphere can also be obtained by, for example, introducing a gas of an appropriate organic substance into a vacuum that has been sufficiently exhausted using an ion pump. The preferable gas pressure of the organic-substance gas varies with the element form, the shape of the vacuum chamber, or the type of the organic substance, so it is set as appropriate.

This activation causes carbon or carbon compounds from the organic substance present in the atmosphere to deposit as the carbon film 5 inside the gap A between the conductive films 4 (FIG. 3D) to increase the emission current $I_e$.

The inventors' studies have found that if the carbon film contains a large amount of amorphous carbon containing a disturbed crystal structure and hydrogen, heating during a stabilization process, which is described below, reduces the amount of carbon film deposited to significantly reduce an element current $I_f$ and the emission current $I_e$.

The activation process applies a voltage in the presence of the organic substance to decompose this substance in order to form the carbon film in the crack formed in the conductive film during the forming process.

One of the features of the present manufacturing method is the use of an aromatic compound having a polarity or a polar group, as the organic substance for the activation process.

In general, with respect to the ratio of carbon atoms to all atoms constituting the compound, aromatic compounds have a larger ratio than aliphatic compounds. They also have a lower reactivity and a better thermal stability than aliphatic compounds. The activation process is considered to form carbons by applying a voltage to the organic substance, irradiating it with electrons, or heating it to cause reaction such as decomposition, polymerization, or dehydration. Due to the above characteristics of the aromatic compound, only a small rate of hydrogen atoms remain in the carbon film and thermal side reaction is unlikely to occur. Accordingly, the crystal structure of the carbon film obtained is expected to be stable. Consequently, the activation process using the aromatic compound can improve the thermal and chemical stability of the carbon film deposited on the elements, thereby reducing the decrease in the amount of carbon film caused by the heating during the stabilization process to restrain the decrease in element current $I_f$ and emission current $I_e$.

The voltage applied during the activation process induces intense fields in the gap, and these fields affect the organic substance attached to the crack.

Since the aromatic compound has in its aromatic ring n electrons that are polarized easily, its molecules are easily polarized and oriented when the fields are applied thereto.

If the aromatic compound has a substituent having a polarity, such polarization effected by the fields is amplified by the electron accepting or donating property of the substituent.

This amplification enhances the trend to cut bonds at particular positions in the molecule or to limit reacting positions due to the polar groups, thereby making the subsequent side reaction such as polymerization or decomposition to further improve the crystallinity of the generated carbon film.

This invention is characterized by the use of the aromatic compound having a polarity.

The polarity of a compound is generally described by the magnitude of the value of a dipole moment. The polarity of the compound increases with increasing dipole moment value. In addition, a compound without a polarity has a dipole moment value of zero.

Specifically, aromatic compounds having a polarity include toluene, o-xylene, m-xylene, ethylbenzene, phenol, benzoic acid, fluorobenzen, chlorobenzen, bromobenzene, styrene, aniline, benzonitrile, nitrobenzene, p-tolunitrile, m-tolunitrile, o-tolunitrile, and pyridine.

This invention is also characterized by the use of the aromatic compound having a polar group.

The polar group may have either an electron accepting or donating property. These properties of the substituent of the aromatic compound are indicated by a α value according to the Hammett rule. That is, a positive σ value indicates an electron accepting substituent, while a negative σ value indicates an electron donating substituent. In addition, the electron accepting or donating effect increases with increasing absolute σ value.

According to this invention, the polar group includes a methyl group, an ethyl group, an amino group, a hydroxyl group, a carboxyl group, a cyano group, a nitro group, an acethyl group, an amide group, and a vinyl group.

This invention can use an aromatic compound having a cyano group, as a preferable aromatic compound having a polarity or a polar group. Specifically, such aromatic compounds include benzonitrile and p-tolunitrile.

The cyano group is assumed to be free from side reaction during the activation process and to provide a higher crystallinity of the carbon film because it is a polar group having a more excellent electron-withdrawing property than the other substituents and because it has a simple structure even after desorption from the aromatic ring during the activation process.

Another feature of the present manufacturing method is that the ratio of the partial pressure of water to the partial pressure of the aromatic compound is 100 or less, preferably 10 or less, more preferably 0.1 or less, particularly preferably 0.001 or less during the activation process in an atmosphere containing the aromatic compound having a polarity or a polar group. Even if, for example, water is removed prior to the activation process by heating a chamber under vacuum, this invention requires only a small amount of time for this operation and provides substantially available electron emission elements.

As described above, during the activation, carbons or carbon compounds from the organic substance present in the atmosphere deposit on the elements to significantly vary the element current $I_f$ and the emission current $I_e$. However, water is generally assumed to affect the activation process because the carbon material reacts with water at a high temperature to become carbon monoxide, carbon dioxide, and methane.

During the activation process, as the partial pressure of water increases relative to the partial pressure of the organic substance, the substance's reaction forming the carbon film may be hindered to prevent a sufficient amount of film from being obtained despite activation lasting a specified amount of time. In this case, the deposited carbon film may contain amorphous carbon containing a disturbed crystal structure or hydrogen. Such a deposit has a low thermal or chemical stability, so the carbon film is easily lost due to heating during the stabilization process after the activation process or due to the driving of the elements. Consequently, the initial electron emission amount or efficiency (defined as the ratio of the emission current to the element current) of the electron emission elements obtained may decrease or the temporal degradation caused by driving may advance.

In general, the preferable partial pressure of the organic substance in the atmosphere used for the activation process varies with the type of the organic substance or a vapor pressure.

During the activation process, despite differences depending on the magnitude of the vapor pressure, as the partial pressure of the organic substance in the activation process atmosphere increases, adsorption increases to increase the amounts of carbon film deposited and a leakage current from the element current $I_f$ while reducing the electron emission efficiency. Thus, provided that a desired element current can be obtained within a certain period of time during the activation process, the partial pressure of the organic substance in the atmosphere is preferably minimized so that the activation process is executed with the adsorption reduced.

In the case of an organic substance such as methane or ethylene having a smaller molecular weight, the vapor pressure is relatively high. Thus, if the partial pressure is excessively reduced during the activation process, the adsorption by the element surface may decrease, resulting in the need for a relatively large amount of time for reaction that forms the carbon film from the organic substance or virtually disabling the reaction.

On the contrary, when the organic substance used for the activation process contains the aromatic compound used in this invention and has a relatively large molecular weight and a low vapor pressure, the adhesion of the substance to the element substrate and the cohesion of the molecules tend to improve to increase the number of molecules adsorbed by the elements. If, however, the organic substance has an excessively low vapor pressure, the adhesion and cohesion become further noticeable, so in forming the atmosphere for the activation process, the organic substance may be prevented from being introduced or a large amount of time may be required for introduction/exhaust due to the significant effect of the conductance of a gas in a gas introducing pipe to the vacuum chamber, an enclosure in which the electron source substrate is encased, or an exhaust pipe.

If an organic substance having a large molecular weight is used for the activation process, the partial pressure of the organic substance in the atmosphere is preferably minimized to allow the activation process to be executed with the adsorption reduced.

Under this condition, the partial pressure is close to the value of the background pressure (approximately between $1.3\times10^{-5}$ and $1.3\times10^{-3}$ Pa) of a vacuum atmosphere into which the organic substance is introduced, and the substance is susceptible to water in the vacuum atmosphere, if any.

If the organic substance is the aromatic compound having a polarity or a polar group, then due to its large molecular weight and polarity, its molecules interact well and their adhesion and cohesion are firm. Accordingly, the partial pressure of the substance in the atmosphere is preferably reduced for activation, and the adverse effect of water must be taken into account.

This invention, however, has found that the effects of water can be reduced during the activation process by using for the organic substance the aromatic compound having a polarity or a polar group. This phenomenon can be described as follows.

(1) Since the aromatic compound is relatively thermally stable, its reactivity with water (hydrolysis or addition reaction) is low despite the presence of water on the element substrate during the activation process.

(2) During the reaction of the aromatic compound having a polarity or a polar group, the orientation of the molecules effected by polarization restricts the reaction with water.

(3) The reactivity of the carbon film formed by the activation process is low. For example, it contains only a small amount of hydrogen and almost all bonds in the film are terminated.

Consequently, by using as the organic substance the aromatic substance having a polarity or a polar group, using an appropriate small partial pressure to stably maintain the atmosphere of the activation process, and controlling the partial pressure of water in the atmosphere relative to the partial pressure of the organic substance as described above, high-grade electron emission elements can be obtained that initially have a large electron emission amount and efficiency and that can prevent the subsequent temporal degradation caused by driving.

According to this invention, the partial pressure ratio of water to the aromatic compound having a polarity or a polar group during the activation process can be measured using a quadruple mass spectrometer. To reduce the partial pressure ratio of water, the elements prior to the activation process and a sample chamber (a container) into which the organic substance is introduced, and preferably even an introducing system such as pipes and valves for introducing the organic substance are desirably heated under vacuum to reduce the amount of water adsorbed. In particular, in the case of a display panel having the electron source substrate described below, the panel is composed of a large glass substrate and has a low vacuum exhaust conductance, so it is difficult to remove water from inside the panel. Thus, heating must be continued under vacuum at a high temperature over a long period of time. Moreover, even if the conductance is improved using the above process control, it is very effective to use the introduced gas after passing through a filter that selectively adsorbs water or to provide a process functional in introducing the organic substance into the vacuum atmosphere for ionizing water molecules to accelerate them in a particular direction for independent exhaust, in order to reduce the partial pressure of water relative to a desired partial pressure of the organic substance stably.

Figure 5:
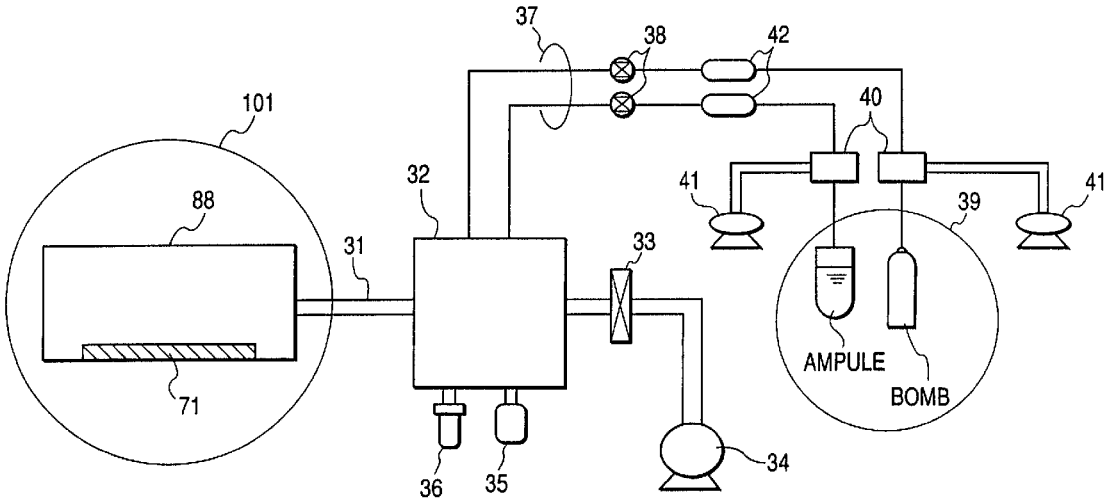
FIG. 5 is a schematic block diagram of a vacuum apparatus for an activation process according to this invention.

FIG. 5 is an image drawing of an apparatus preferably used for the activation process according to this invention. An image forming device 101 is coupled to a vacuum chamber 32 via an exhaust pipe 31, and is further connected to an exhausting device 34 via a gate valve 33. A pressure meter 35 and a quadruple mass spectrometer 36 are mounted on the vacuum chamber 32 to measure its internal pressure and the partial pressure of each component in the atmosphere. Since it is difficult to directly measure the internal pressure of an enclosure 88 for the image display device 101, the internal pressure of the vacuum chamber 32 is measured to control processing conditions. A gas introducing line 37 is also connected to the vacuum chamber 32 to introduce a required gas into the chamber 32 to control the atmosphere. An introduced-substance source 39 is connected to the other end of the line 37, and an introduced substance is stored in the source 39 in an ampule or a bomb. An introduced-amount controlling means 38 for controlling the rate at which the substance is introduced and a filter 42 for selectively adsorbing water from the gas are provided in the middle of the line 37. Specifically, the introduced-amount controlling means 38 comprises a valve such as a slow leak valve (a needle valve) that can control the gas flow or a mass flow controller depending on the type of the introduced substance. A filter 42 selectively adsorbing water may comprise an inert carrier and a material such as $MgCl_2$ or $CaCl_2$ that is coated thereon and that adsorbs water upon reaction.

Figure 6A:
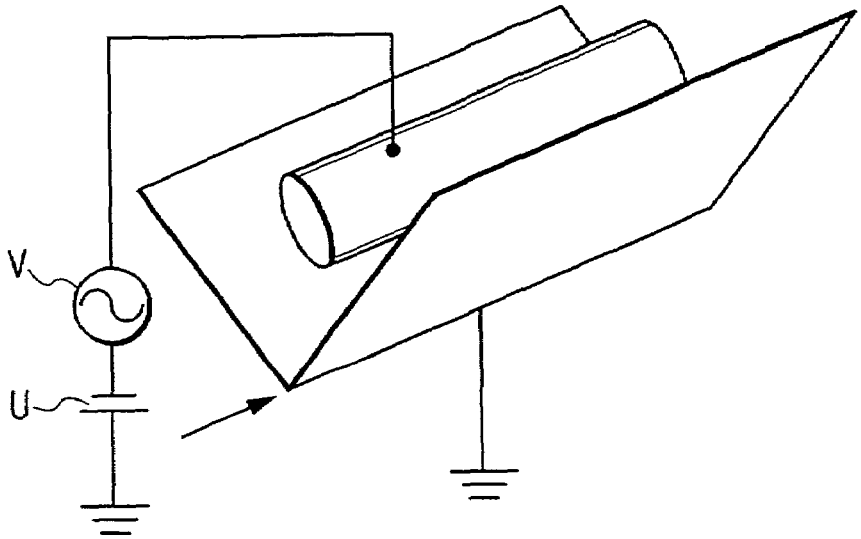
FIGS. 6A and 6B are image drawings showing an example of the structure of mass filter electrodes used for the activation process according to this invention.
Figure 6B:
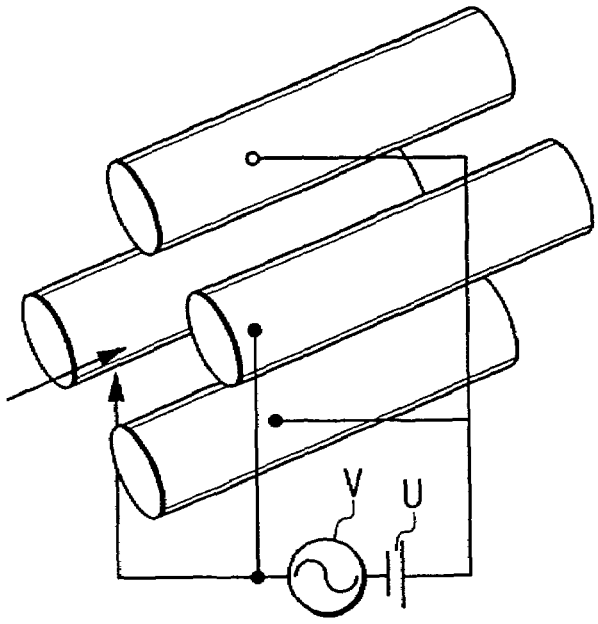

In this apparatus, when a mass filter 40 is provided before the gas-introduced amount-controlling means 38 and an optimal ionizing condition has been established, the exhausting device 41 can remove water molecules of molecular weight 18 in a concentrated manner. FIGS. 6A and 6B show typical structures of the mass filter. Monopole (FIG. 6A) or quadruple (FIG. 6B) electrodes are arranged precisely and a temporally varying voltage is applied to each of them to generate quadruple two-dimensional electric fields around a specified axis. Then, charged particles are (mass (m), charge (q)) moved near and along the axis so as to be mutually discriminated depending on m/q. When superimposed DC and AC voltages are applied to each electrode to temporally vary the electric fields around the axis, the traces of the charged particles moving near and along the axis become stable or unstable depending on m/q. These particle traces are expressed as the solution of the Mathieu equation, and the conditions for the stability of each charged particle (m, q) are analytically given based on the values of the DC and AC voltages U and V. Thus, by varying U and V precisely according to a specified time schedule, the charged particles can be mutually discriminated based on the magnitude of m/q. Typical electrode forms include (a) monopole and (b) quadruple electrodes that serve to generate wide quadruple electric fields precisely. An ion pump in the exhausting device 41 exhausts the water molecules discriminated by a particular acceleration to reduce the partial pressure of water before the gas introducing line 37. Although FIG. 5 shows an ampule and a bomb, either one or both of the gas introducing means may be used as appropriate depending on the substance required for the activation process, examples of which have been listed above, or on an activation gas. Either one or both of the filter 42 and the mass filter 40 may be used to remove water.

By using the apparatus in FIG. 5 to exhaust the inside of the enclosure 88, the above forming process can be executed.

According to this invention, the voltage application approach for the activation process involves conditions such as the temporal variation of the voltage value, the direction of voltage application, and the waveform.

To temporally vary the voltage value, the value may be increased over time as in the forming or a fixed voltage may be used.

Figure 7A:
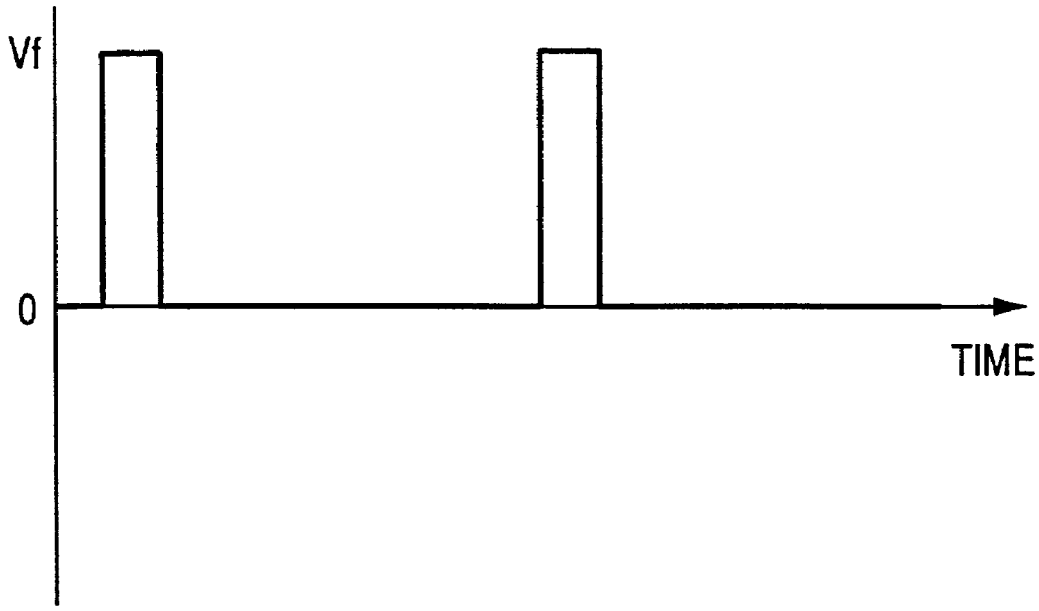
FIGS. 7A and 7B show examples of voltage waveforms for the activation process according to this invention.
Figure 7B:
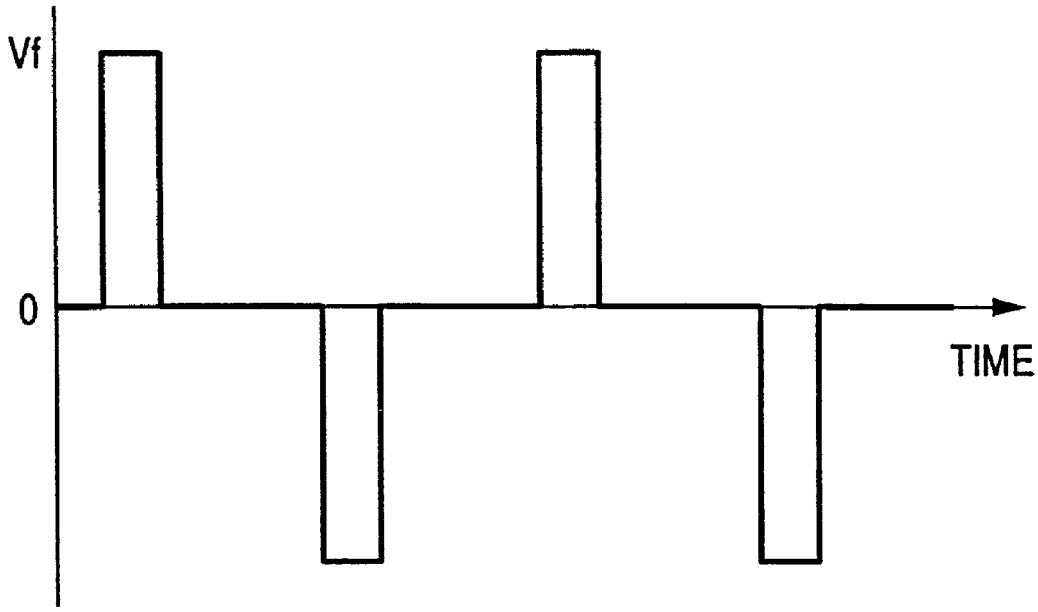

In addition, as shown in FIGS. 7A and 7B, the voltage may be applied only in a direction similar to the driving direction (forward) (FIG. 7A) or may be applied alternatively in the forward and backward directions (FIG. 7B). The alternative voltage application is preferred because the carbon film is formed symmetrically around the crack.

With respect to the waveform, FIGS. 7A and 7B show examples of a rectangular wave, but an arbitrary wave such as a sine wave, a chopping wave, or a saw-tooth wave may be used.

The end of the activation process can be determined as appropriate while measuring the element current $I_f$ and the emission current $I_e$.

5) Stabilization Process

The electron emission elements obtained through these processes are preferably subjected to the stabilization process. This process exhausts the organic substance from the vacuum chamber and applies a voltage to the electron emission elements in this atmosphere. Preferably, an evacuation device for exhausting the vacuum chamber does not use oil because oil from the device may affect the characteristics of the elements. Specifically, a vacuum evacuation device such as a sorption pump or an ion pump may be used. The partial pressure of the organic component in the vacuum chamber is preferably $1.3\times10^{-6}$ Pa or less, particularly preferably $1.3\times10^{-8}$ Pa or less so as to virtually prevent the carbons or the carbon compounds from depositing. Furthermore, in exhausting the vacuum chamber, the entire vacuum chamber is preferably heated to allow the organic-substance molecules adsorbed by the inner wall of the chamber and the electron emission elements to be exhausted easily. The chamber is desirably heated at 80 to 200° C., preferably 150° C. or more as long as possible. The heating, however, is not limited to these conditions and can use conditions selected based on factors such as the size and shape of the vacuum chamber and the configuration of the electron emission elements. The pressure inside the chamber must be minimized and is preferably $1.3\times10^{-5}$ Pa or less, particularly preferably $1.3\times10^{-6}$ Pa.

As the atmosphere for driving subsequent to the stabilization process, the atmosphere at the end of the driving is preferably maintained. The atmosphere, however, is not limited to this aspect, and sufficiently stable characteristics can be maintained despite a slight decrease in vacuum as long as the organic substance has been sufficiently removed. The employment of such a vacuum atmosphere hinders new carbons or carbon compounds from depositing to stabilize the element current $I_f$ and the emission current $I_e$.

After the activation process, the organic substance may be simply exhausted from the vacuum chamber without the voltage application during the stabilization process, and subsequently the elements may be driven.

According to the method for manufacturing the electron emission element according to this invention, elements can be obtained that can maintain their characteristics even after the stabilization process due to a small decrease in element current $I_f$ and thus emission current $I_e$.

The basic characteristics of the present electron emission elements obtained through the above processes will be explained with reference to FIGS. 8 to 10.

Figure 8:
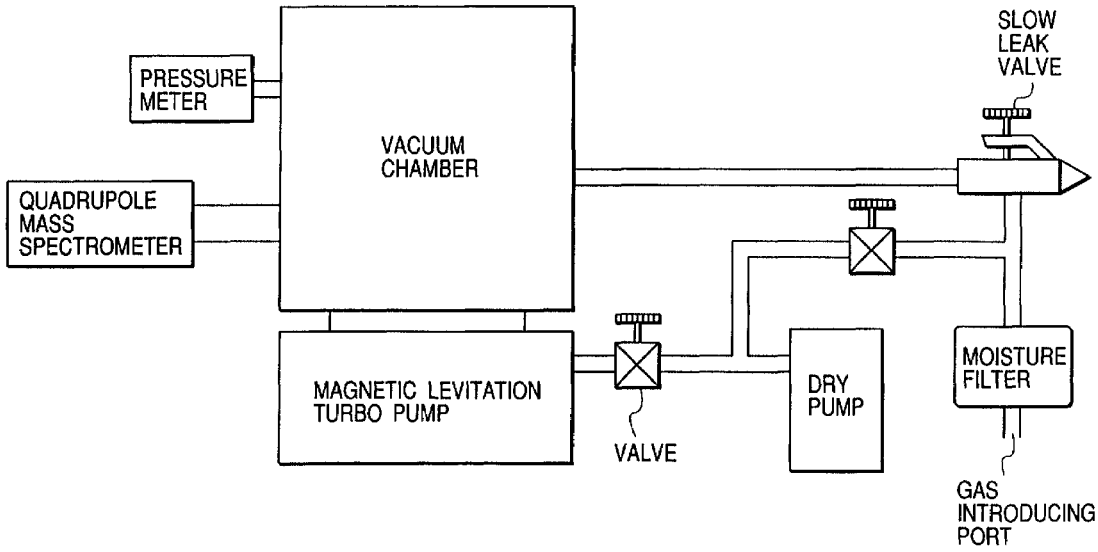
FIG. 8 is a schematic block diagram of a measuring and evaluating apparatus for measuring an electron emission characteristic.

FIG. 8 is an image drawing showing part of a vacuum processing apparatus. This apparatus also functions as a measuring and evaluating apparatus and comprises in the vacuum chamber a measuring and evaluating apparatus configured as shown in FIG. 9. In this figure, the same sites as shown in FIGS. 1A and 1B have the same reference numerals.

Figure 9:
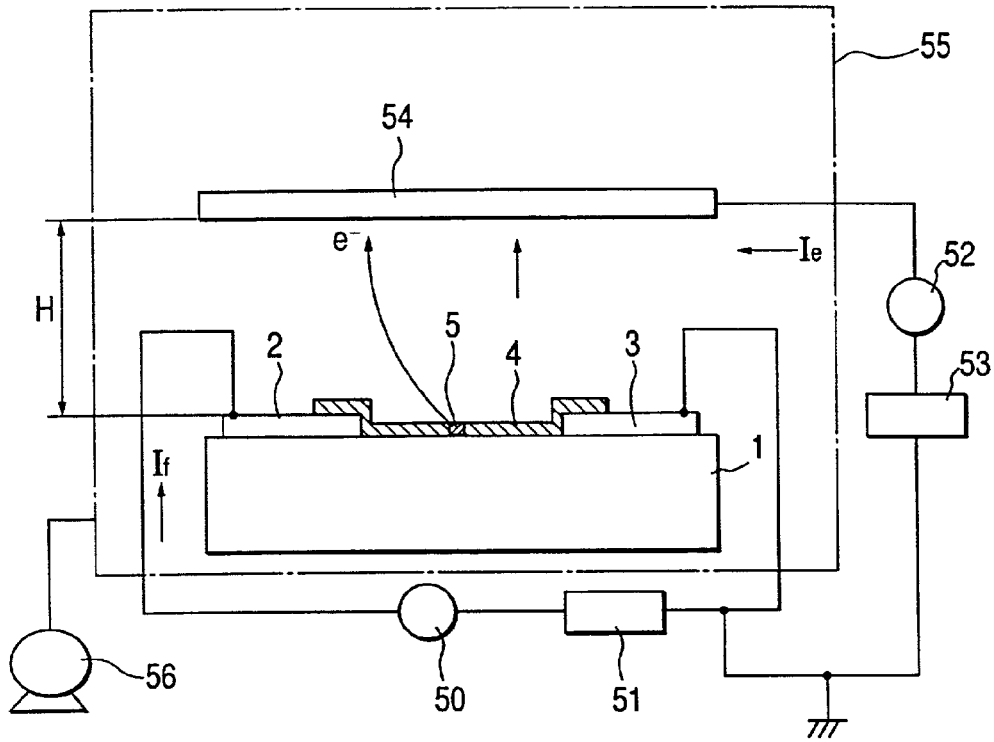
FIG. 9 is a schematic block diagram of a vacuum chamber (a sample chamber) in the measuring and evaluating apparatus in FIG. 8.

In FIG. 9, 55 is a vacuum chamber. Electron emission elements are arranged inside the vacuum chamber 55. In addition, 51 is a power supply for applying an element voltage $V_f$ to the electron emission elements, 50 is an ammeter for measuring the element current $I_f$ flowing through the conductive film 4 between the element electrodes 2 and 3, 54 is an anode electrode for capturing the emission current $I_e$ emitted from the electron emission section 5 of the element, 53 is a high-voltage power supply for applying a voltage to the anode electrode 54, and 52 is an ammeter for measuring the emission current $I_e$ emitted from the electron emission section 5. Measurements can be conducted by, for example, setting the voltage of the anode electrode 54 between 1 and 10 kV and the distance H between the anode electrode 54 and the element between 2 and 8 mm.

The vacuum chamber 55 has inside equipment such as a vacuum gauge (not shown) required for measurements in a vacuum atmosphere in order to carry out measurements and evaluations in a desired vacuum atmosphere.

Although FIG. 8 shows an exhaust pump to be a normal high-vacuum device consisting of a turbo pump and a dry pump, this pump may be configured with a very-high-vacuum device consisting of an ion pump. A heater (not shown) can entirely heat the vacuum processing apparatus shown in this figure and including an electron emission element substrate. A gas can be introduced into the vacuum chamber in this vacuum apparatus through a gas introducing port. The gas introduced through the gas introducing port has its moisture removed by a water adsorbing filter and is then fed into the vacuum chamber via a slow leak valve (a needle valve). Thus, by means of the use of the vacuum processing apparatus capable of inducing an organic substance as a gas type allows performance of the processes following that of conductive forming described above.

Figure 10:
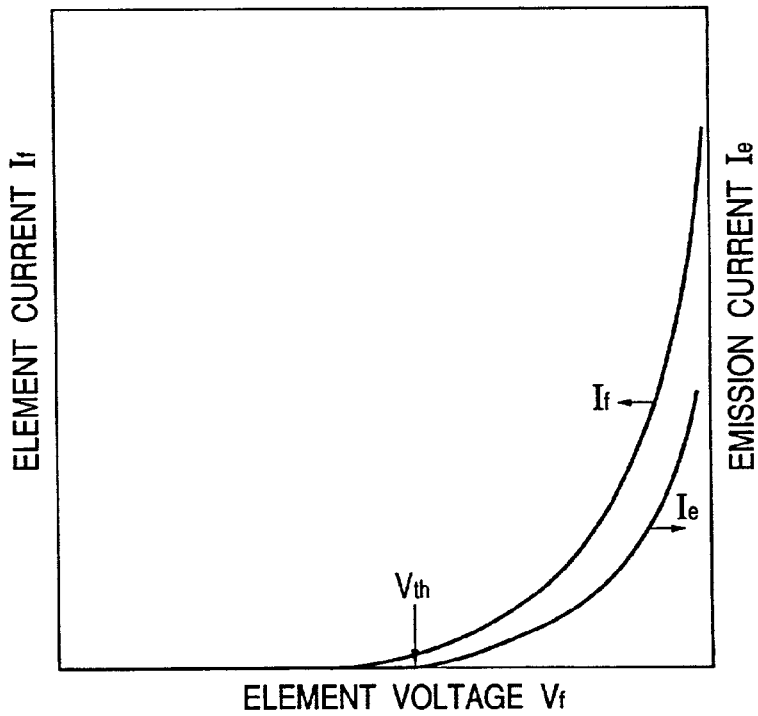
FIG. 10 is a graph showing the electron emission characteristic of the electron emission element according to this invention.

FIG. 10 is a chart showing the relationship between the emission and element currents $I_e$ and $I_f$ and the element voltage $V_f$ which have been measured using the vacuum processing apparatus shown in FIGS. 8 and 9. In this figure, the values are shown in arbitrary units because the emission current $I_e$ is significantly lower than the element current $I_f$. Both the vertical and horizontal axes are on a linear scale.

As shown in FIG. 10, the electron emission element according to this invention exhibits the following three characteristics with respect to the emission current $I_e$.

First, when an element voltage higher than or equal to a certain value (that is called a "threshold voltage"; $V_{th}$ in FIG. 10) is applied to this element, the emission current $I_e$ increases rapidly. On the other hand, below the threshold voltage $V_{th}$, few emission currents $I_e$ are detected. That is, this is a non-linear element having the clear threshold voltage $V_{th}$ for the emission current $I_e$.

Second, since the emission current $I_e$ increases monotonously relative to the element voltage $V_f$, the emission current $I_e$ can be controlled using the element voltage $V_f$.

Third, the amount of emitted charges captured by the anode electrode 54 (see FIG. 9) depend on the time over which the element voltage $V_f$ is applied. That is, the amount of charges captured by the anode electrode 54 can be controlled using the time over which the voltage $V_f$ is applied.

As understood from the above description, the electron emission elements obtained according to the present manufacturing method can easily control the electron emission characteristic in response to an input signal. This nature enables various applications including an electron source and an image forming apparatus both having a plurality of electron emission elements arranged therein.

Although FIG. 10 shows the example in which the element current $I_f$ increases monotonously relative to the element voltage $V_f$ (MI characteristic), the current $I_f$ may exhibit a voltage controlled negative resistance characteristic (VCNR characteristic) according to the voltage $V_f$ (not shown). These characteristics can be controlled by controlling the above processes.

Next, an electron source to which this invention can be applied and its application will be described. An electron source or an image forming apparatus can be configured by arranging a plurality of the above electron emission elements on a substrate.

Various arrangements of the elements can be used. By way of example, in a ladder-like arrangement, a large number of electron emission elements are arranged in parallel and connected together at both ends, a large number of rows of electron emission elements are provided (the row direction), and control electrodes (also referred to as "grids") arranged above the elements in the direction (the column direction) perpendicular to the wiring in the row direction to control and drive electrons from the elements. In another arrangement, a plurality of electron emission elements are disposed in a matrix in the X and Y directions, and one of the electrodes of each of the elements disposed in the same row is commonly connected to the wiring in the X direction, while the other electrode of each element disposed in the same row is commonly connected to the wiring in the Y direction. This is a so-called simple matrix arrangement. First, the simple matrix arrangement will be explained below in detail.

The electron emission elements obtained according to the present manufacturing method have the three characteristics described above. That is, when the voltage is higher than or equal to the threshold value, the emission current from the surface conduction electron emission elements can be controlled using the peak value and width of the pulse-like voltage applied between the opposed element electrodes. On the other hand, below the threshold voltage, few electrons are emitted. Due to this characteristic, even if a large number of electron emission elements are arranged, appropriate surface conduction electron emission elements can be selected in response to an input signal to control the amount of electrons emitted therefrom by applying a pulse-like voltage to the individual elements as appropriate.

An electron source substrate obtained by disposing, based on the above principle, a plurality of electron emission elements to which this invention can be applied will be described below with reference to FIG. 11.

Figure 11:
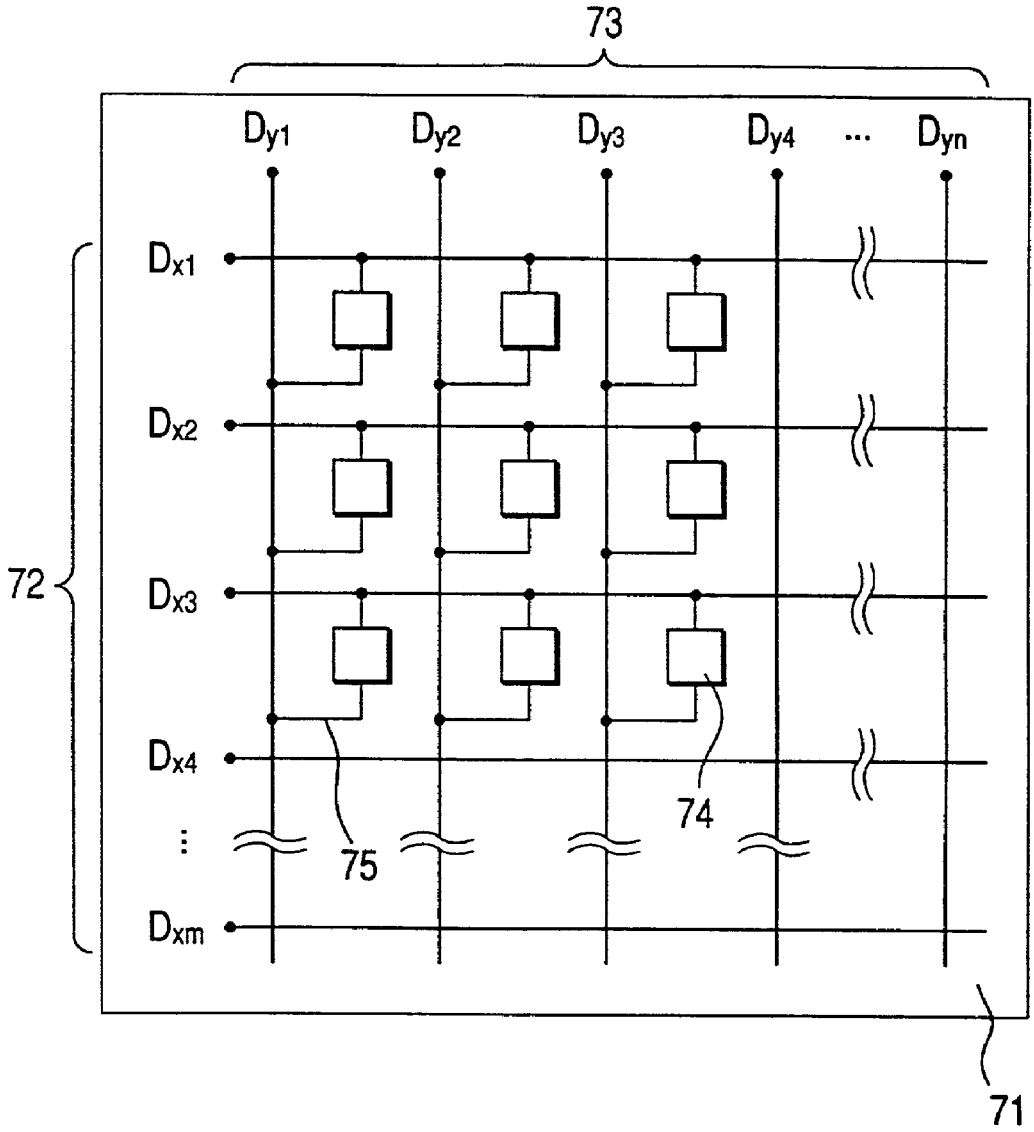
FIG. 11 is an image drawing showing an example of an electron source in a simple matrix arrangement according to this invention.

In FIG. 11, 71 is an electron source substrate, 72 is an X-direction wiring, and 73 is a Y-direction wiring. Reference numeral 74 denotes an electron emission element and 75 is a wire. The electron emission element 74 may be of either the planar or vertical type.

The (m) X-direction wires 72 consist of $D_{0x1}$, $D_{0x2}$, . . . and $D_{0xm}$ and can be composed of a conductive metal formed using the vacuum evaporation method, the printing method, or the sputtering method. The material, thickness, and width of the wiring are designed as appropriate. The (n) Y-direction wiring 73 consists of $D_{0y1}$, $D_{0y2}$, . . . and $D_{0ym}$ and is formed as in the X-direction wiring 72. Inter-layer insulating layers (not shown) are provided among the (m) X-direction wires 72 and the (n) Y-direction wires 73 to electrically separate these wires ((m) and (n) are both positive integers).

The interlayer insulating layer is composed of $SiO_2$ formed using the vacuum evaporation method, the printing method, or the sputtering method. The thickness and material of these layers and the production method therefor are set as appropriate so that the layers are formed in all or part of the surface of the substrate 71 with the X-direction wiring 72 formed thereon and so that they can withstand the potential differences at the intersections between the X- and Y-direction wirings 72 and 73. The X- and Y-direction wirings 72 and 73 are led out as external terminals.

A pair of element electrodes (not shown) constituting the electron emission element 74 are electrically connected to the (m) X-direction wires 72 and the (n) Y-direction wires 73, respectively, using the wires 75 consisting of a conductive metal.

With respect to the materials of the wirings 72 and 73, the wire 75, and the pair of element electrodes, all or some of the components may be the same, or the respective components may be different. These materials are selected as appropriate from, for example, the above materials of the element electrodes. If the materials of the element electrode and the wiring are identical, the wire connected to the element electrode can be considered to be an element electrode.

A scanning signal applying means (not shown) is connected to the X-direction wiring 72 to apply a scanning signal for selecting from the rows of electron emission elements 74 arranged in the X direction. On the other hand, a modulated-signal generating means (not shown) is connected to the Y-direction wiring 73 to modulate each of the rows of electron emission elements 74 arranged in the Y direction, in response to an input signal. A driving voltage applied to each element is supplied as a difference voltage-between the scanning and modulated signals applied to this element.

In this configuration, the matrix wiring is used to select individual elements in order to independently drive them.

Figure 12:
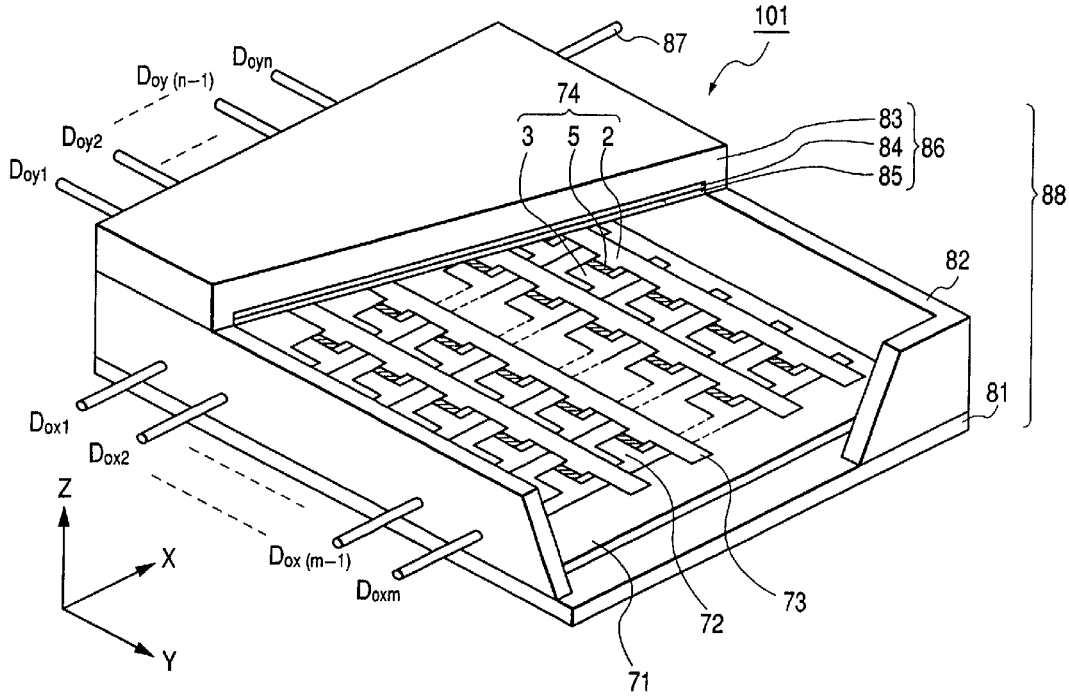
FIG. 12 is an image drawing showing an example of a display panel of an image forming apparatus according to this invention.
Figure 13A:
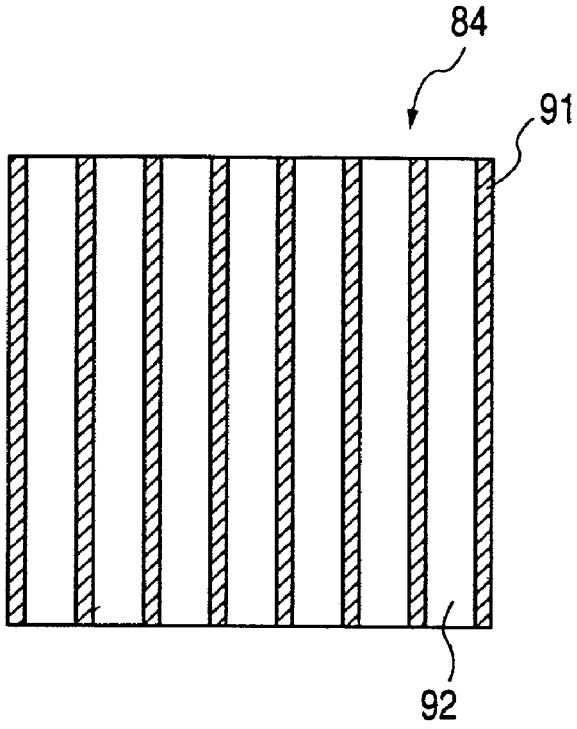
FIGS. 13A and 13B are image drawings showing an example of a fluorescent film in a display panel.
Figure 13B:
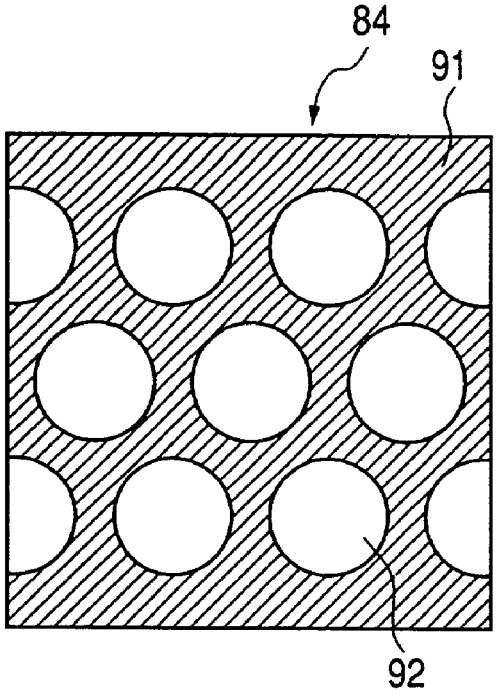
Figure 14:
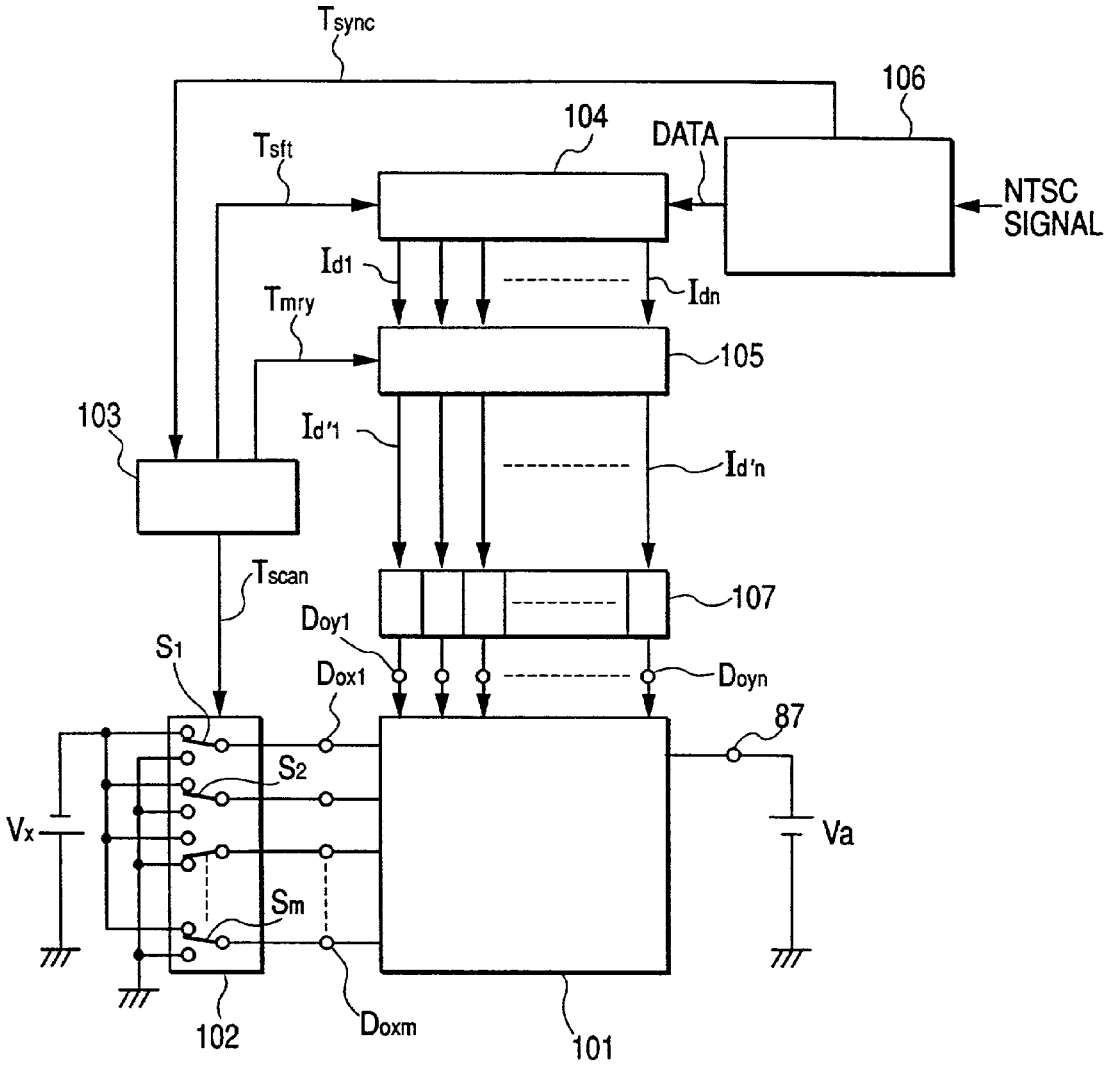
FIG. 14 is a block diagram showing an example of a driving circuit for enabling the image forming apparatus according to this invention to display images in response to television signals based on the NTSC method.

An image forming apparatus configured using the electron source in the simple matrix arrangement will be described with reference to FIGS. 12, 13A, 13B and 14. FIG. 12 is an image drawing showing an example of a display panel of the image forming apparatus: FIGS. 13A and 13B are image drawings of a fluorescent screen used for the image forming apparatus in FIG. 12. FIG. 14 is a block diagram showing an example of a driving circuit for providing a display in response to an NTSC television signal.

In FIG. 12, 71 is an electron source substrate on which a plurality of electron emission elements are arranged, 81 is a rear plate to which the electron source substrate 71 is fixed, and 86 is a face plate comprising a fluorescent screen 84 and a metal back 85 formed in the inner surface of a glass substrate 83. Reference numeral 82 is a supporting frame to which the rear plate 81 and the face plate 86 are connected using frit glass. Reference numeral 88 denotes an enclosure that is sealed by, for example, baking it in the air or nitrogen at 400 to 500° C. for 10 minutes or longer.

Reference numeral 74 designates an electron emission element such as that shown in FIGS. 1A and 1B. Reference numerals 72 and 73 denote X- and Y-direction wirings connected to a pair of element electrodes (not shown) of the element 74.

The enclosure 88 is composed of the face plate 86, the supporting frame 82, and the rear plate 81, as described above. Since the rear plate 81 is provided mainly to reinforce the strength of the substrate 71, the rear plate 81 may be omitted if the substrate 71 itself has a sufficient strength. That is, the supporting frame 82 may be sealed on the substrate 71 in such a way that the face plate 86, the supporting frame 82, and the substrate 71 constitute the enclosure 88. On the other hand, a support (not shown) called a "spacer" can be installed between the face and rear plates 86 and 81 to constitute an enclosure 88 having a sufficient strength against the atmospheric pressure.

FIGS. 13A and 13B are image drawings showing the fluorescent screen. A monochrome fluorescent screen 84 can be composed of only a phosphor. A color fluorescent screen can be composed of phosphors 92 and black conductive materials 91 called a "black stripe" (FIG. 13A) or a "black matrix" (FIG. 13B) depending on the arrangement of the phosphors. The black stripe or matrix is provided to make color mixture unnoticeable by blackening the intermediate area between the phosphors 92 of the required primary-color phosphors and to restrain a decrease in the contrast of the fluorescent screen 84 caused by extraneous-light reflection. The black conductive material 91 may comprise a material normally used and mainly consisting of graphite or a conductive material that restrains transmission and reflection.

The phosphors can be applied to the glass substrate 83 using the precipitation method or the printing method, whether a monochrome or a color fluorescent screen is used. The metal back 85 is normally provided in the inner surface of the fluorescent screen 84. The metal back is provided to improve the illuminance by specularly reflecting to the face plate 86 those of the beams from the phosphors that are directed to the inner surface, to operate as an electrode for applying an electron beam accelerating voltage, and to protect the phosphors from damage caused by the collision of negative ions generated within the enclosure. The metal back can be produced after the production of the fluorescent screen by smoothing the inner surface of the fluorescent screen (normally referred to as "filming") and then using the vacuum evaporation method to deposit Al.

Transparent electrodes (not shown) may be provided on the outer surface of the fluorescent screen 84 to further improve the conductivity of the screen 84.

For the color fluorescent screen, sufficient alignment is required during the above sealing so that each color phosphor corresponds to the respective electron emission element.

The image forming apparatus shown in FIG. 12 can be manufactured, for example, as follows.

As in the stabilization process, during heating as appropriate, the enclosure 88 is exhausted through an exhaust pipe (not shown) using an exhausting device such as an ion pump or a sorption pump that does not use oil in order to obtain an atmosphere having a vacuum of $1.3\times10^{-5}$ Pa and a sufficiently small amount of organic substance, followed by sealing. To maintain the vacuum obtained after the sealing of the enclosure 88, getter processing can be executed. In this processing, immediately before or after the sealing of the enclosure 88, a getter (not shown) located at a predetermined position in the enclosure 88 is heated using resistance or a high frequency to form a deposited film. The getter normally mainly consists of Ba and maintains a vacuum between, for example, $1.3\times10^{-3}$ and $1.3\times10^{-5}$ Pa due to the adsorption effected by the deposited film. The element forming process and the subsequent processes can be set as appropriate.

An example of a configuration of a driving circuit for displaying, based on an NTSC television signal, images on a display panel configured using the electron source in the simple matrix arrangement will be described below with reference to FIG. 14. In this figure, 101 is an image display panel, 102 is a scanning circuit, 103 is a controlling circuit, 104 is a shift register, 105 is a line memory, 106 is a synchronization signal separating circuit, 107 is a modulated-signal generator, and $V_x$ and $V_a$ are DC voltage sources.

The display panel 101 is connected to an external electric circuit via terminals $D_{0x1}$ to $D_{0xm}$, terminals $D_{oy1}$ to $D_{0yn}$, and a high-voltage terminal 87. To the terminals $D_{0x1}$ to $D_{0xm}$ is applied a scanning signal for sequentially driving one row at a time, the electron source provided in the display panel 101, that is, the group of electron emission elements connected together in a (m)×(n) matrix. To the terminals $D_{OY1}$ to $D_{0yn}$ is applied a modulated signal for controlling an output electron beam from each of the electron emission elements in one row selected by the scanning signal. The DC voltage source $V_a$ supplies, for example, a 10 kVDC to the high-voltage terminal 87, and this voltage is an acceleration voltage used to apply sufficient energy to excite the phosphors, to electron beams emitted from the elements.

The scanning circuit 102 will be explained. This circuit comprises (m) switching elements (in the image drawing, these elements are shown at $S_1$ to $S_m$) inside. Each switching element selects either the output voltage from the DC voltage power supply $V_x$ or 0 V (ground level) and is electrically connected to the terminals $D_{0x1}$ to $D_{0xm}$ of the display panel 101. Each of the switching circuits $S_1$ to $S_m$ operates based on a controlling signal Tscan output by the controlling circuit 103, and can be configured by combining switching elements, for example, FETs together.

According to this example, based on a characteristic of the electron emission elements (an electron emission threshold voltage), the DC voltage source $V_x$ is set to output a constant voltage so that the driving voltage applied to those elements not being scanned is lower than or equal to this threshold voltage.

The controlling circuit 103 can coordinate the operation of each section so as to provide an appropriate display based on an externally input image signal. Based on a synchronization signal Tsync sent from the synchronization signal separating circuit 106, the controlling circuit 103 generates each controlling signal Tscan, Tsft, or Tmry to each section.

The synchronization signal separating circuit 106 separates synchronization and illuminance signal components from an externally input NTSC television signal and can be composed of a general frequency separating (filter) circuit. The synchronization signal separated by the circuit 106 consists of vertical and horizontal synchronization signals, but is shown as the Tsync signal for convenience of explanation. The image illuminance signal component separated from the television signal is represented as a DATA signal for convenience. The DATA signal is input to the shift register 104.

The shift register 104 converts the DATA signals input serially according to a time series into parallel data for each image line, and operates based on the controlling signal Tsft transmitted from the controlling circuit 103 (that is, the controlling signal Tsft may be considered to be a shift clock for the shift register 104). The shift register 104 outputs the serial/parallel-converted data for one image line (corresponding to driving data for the (n) electron emission elements), as (n) parallel signals Idl to Idn.

The line memory 105 is a storage device that stores data for one image line for a required amount of time, and stores the contents of Idl to Idn as appropriate according to the controlling signal Tmry sent from the controlling circuit 103. The stored contents are output as Id'1 to Id'n and input to the modulated-signal generator 107.

The generator 107 is a signal source for driving and modulating each electron emission element according to the image data Id'1 to Id'n, and an output signal therefrom is applied to the elements in the display panel 101 through the terminals $D_{OY1}$ to $D_{0yn}$.

As described above, the electron emission element to which this invention can be applied has the following basic characteristic for the emission current $I_e$. Due to the presence of the clear threshold voltage $V_{th}$, electrons are emitted only when a voltage higher or equal to $V_{th}$ is applied. At such a voltage value, the emission current varies with the voltage applied to the elements. Thus, if a pulse-like voltage is applied to these elements and the voltage is, for example, lower than the electron emission threshold, electron emission does not occur. Above this threshold, however, electron beams are output. At this point, the intensity of the output electron beams can be controlled by varying the peak value Vm of the pulse. In addition, the total amount of charges in the output electron beams can be controlled by varying the width Pw of the pulse.

Thus, the voltage modulation or pulse width modulation methods can be used as a method for modulating the electron emission elements in response to an input signal. To implement the voltage modulation method, the modulated-signal generator 107 may comprise a circuit that generates a voltage pulse of a constant length and that can modulate the peak value of the pulse as appropriate depending on input data. To implement the pulse width modulation method, the modulated-signal generator 107 may comprise a circuit that generates a voltage pulse having a constant peak value and that can modulate the width of the pulse as appropriate depending on input data.

The shift register 104 and the line memory 105 may be of either a digital or an analog signal type. This is because they must only be able to serial/parallel-convert or store image signals at a predetermined speed.

To use the digital signal type, the output signal DATA from the synchronization signal separating circuit 106 must be converted into a digital signal. This, however, can be achieved by providing an A/D converter in the output section of the circuit 106. With regard to this, a circuit used for the modulated-signal, generator 107 slightly varies depending on whether the output signal from the line memory 105 is digital or analog. That is, for the voltage modulation method using digital signals, the generator 107 comprises, for example, a D/A conversion circuit and includes an additional amplifying circuit as required. For the pulse width modulation method, the modulated-signal generator 107 comprises, for example, a circuit consisting of a combination of a fast oscillator, a counter for counting the number of waves output from the oscillator, and a comparator for comparing an output value from the counter with an output value from the memory. An amplifier can also be added as required that amplifies the voltage of a pulse-width-modulated signal output from the comparator up to the value of the driving voltage for the electron emission elements.

For the voltage modulation method using analog signals, the modulated-signal generator 107 can comprise, for example, an amplifying circuit using an operation amplifier and can include an additional level shift circuit as required. For the pulse width modulation method, the circuit 107 can comprise, for example, a voltage controlled oscillating (VCO) circuit and can include an additional amplifier as required that amplifies the voltage up to the value of the driving voltage for the electron emission elements.

In the present image forming apparatus that can be configured as described above, electrons are emitted from the electron emission elements by applying a voltage to each element via extra-chamber terminals $D_{0x1}$ to $D_{0xm}$ and $D_{0y1}$ to $D_{0ym}$. A high voltage is applied to the metal back 85 or the transparent electrode (not shown) via the high-voltage terminal 87 to accelerate electron beams. The accelerated electrons collide against the fluorescent screen 84 to emit light, thereby forming an image.

This configuration of an image forming apparatus is an example of the image forming apparatus according to this invention, and can be varied in various manners based on the technical concept of this invention. Although the NTSC signal has been described, the input signal is not limited to this aspect, and the PAL or SECAM method or a TV signal method consisting of more scanning lines (for example, a high-grade TV signal method including MUSE) can be employed.

Next, the electron source and image forming apparatus in the ladder type arrangement will be described with reference to FIGS. 15 and 16.

Figure 15:
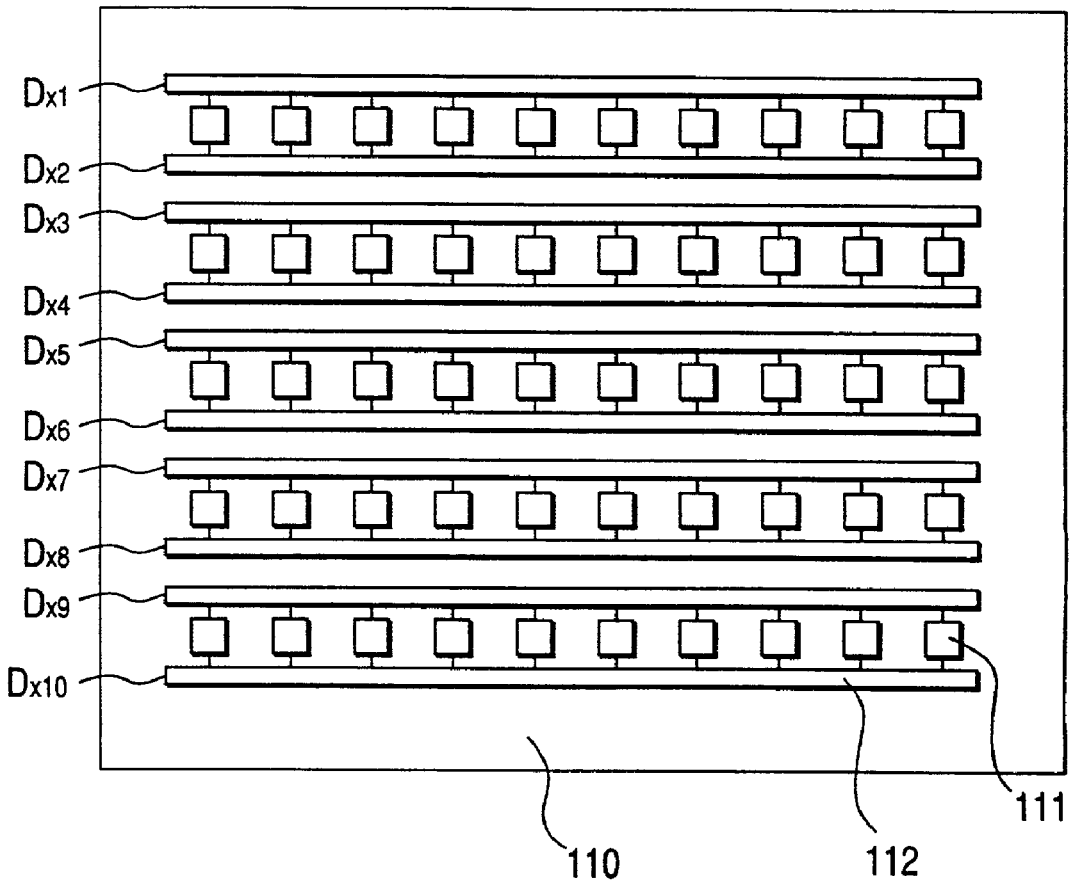
FIG. 15 is an image drawing showing an example of an electron source in a ladder arrangement according to this invention.

FIG. 15 is an image drawing showing an example of an electron source in the ladder type arrangement. In this figure, 110 is an electron source substrate, and 111 is an electron emission element. Reference numeral 112 denotes common wires $D_{x1}$ to $D_{x10}$ to which the elements 111 are connected and these wires are led out as external terminals. A plurality of elements 111 are arranged on the substrate 110 in parallel in the X direction (this is called an "element row"). A plurality of element rows are arranged so as to constitute an electron source. A driving voltage is applied between the common wires along each element row to enable each row to be independently driven. That is, a voltage higher than or equal to the electron emission threshold is applied to those element rows from which electron beams are to be emitted, whereas a voltage lower than this threshold is applied to those element rows from which electron beams are not to be emitted. The common wires $D_{x2}$ to $D_{x9}$, located between the respective element rows may be configured in such a way that, for example, $D_{x2}$ and $D_{x3}$, $D_{x4}$ and $D_{x5}$, $D_{x6}$ and $D_{x7}$, and $D_{x8}$ and $D_{x9}$ are integrated respectively in the same manner.

Figure 16:
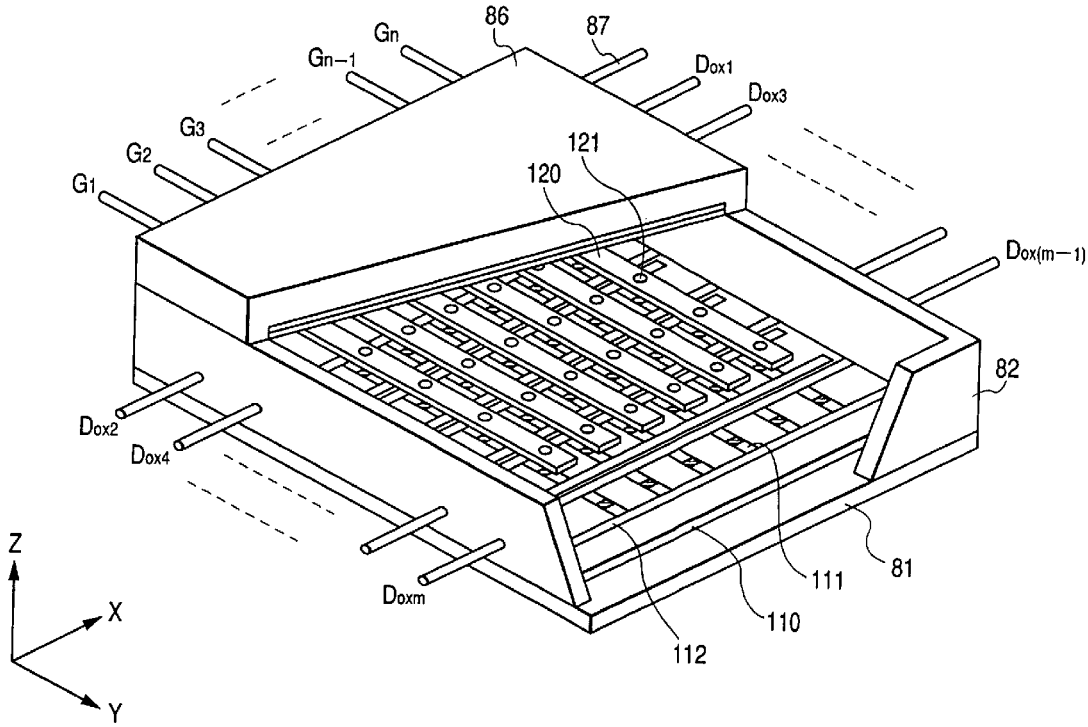
FIG. 16 is an image drawing showing an example of a display panel of the image forming apparatus according to this invention.
Figure 17A:
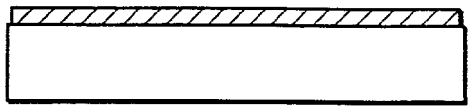
FIGS. 17A, 17B, 17C and 17D are process drawings describing a method for manufacturing an electron emission element according to this invention.
Figure 17B:
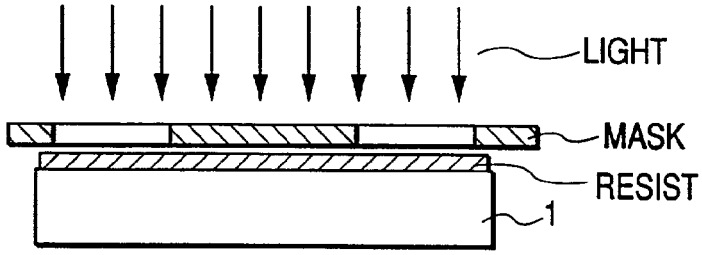
Figure 17C:
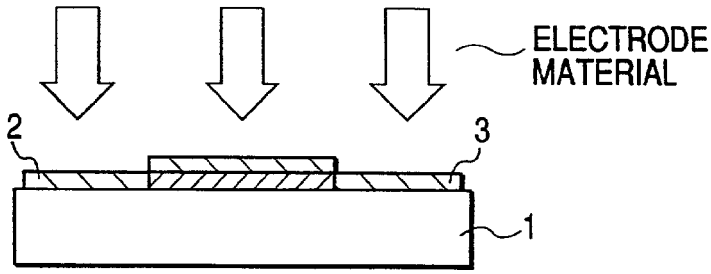
Figure 17D:
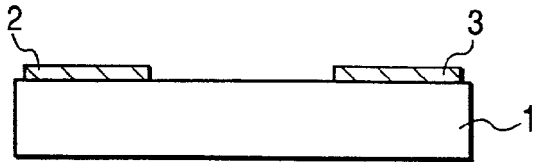
Figure 18E:
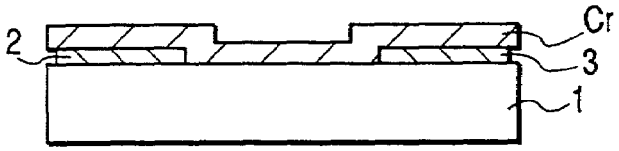
FIGS. 18E, 18F, 18G and 18H are process drawings describing the method for manufacturing the electron emission element according to this invention.
Figure 18F:
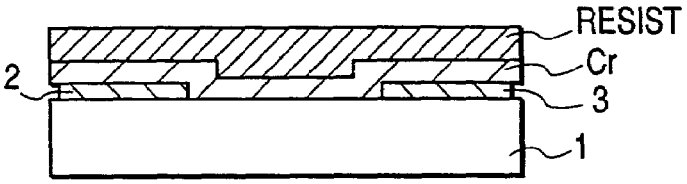
Figure 18G:
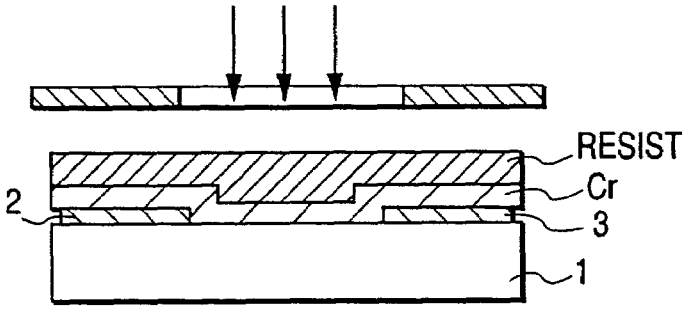
Figure 18H:
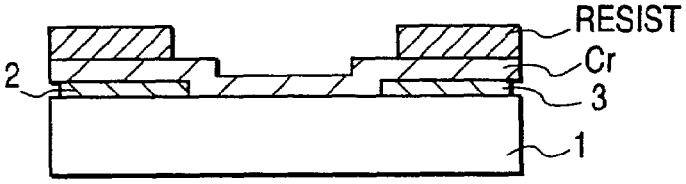
Figure 19I:
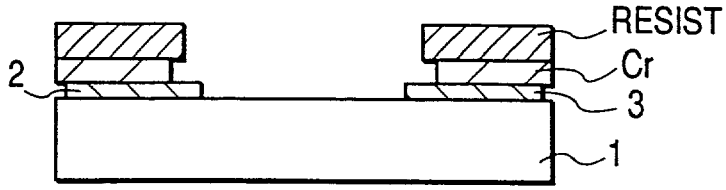
FIGS. 19I, 19J, 19K and 19L are process drawings describing the method for manufacturing the electron emission element according to this invention.
Figure 19J:
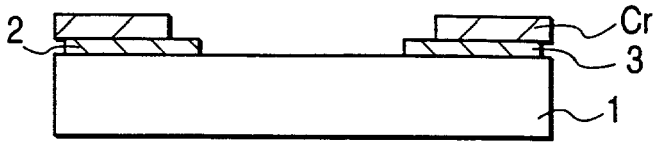
Figure 19K:
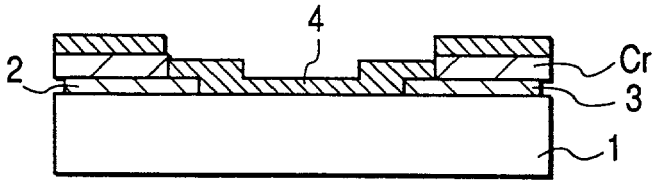
Figure 19L:
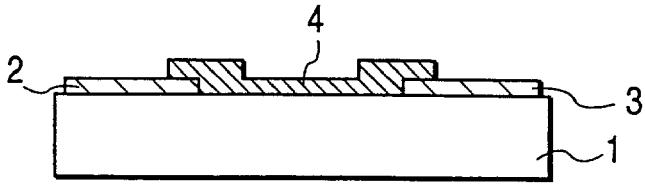
Figure 20M:
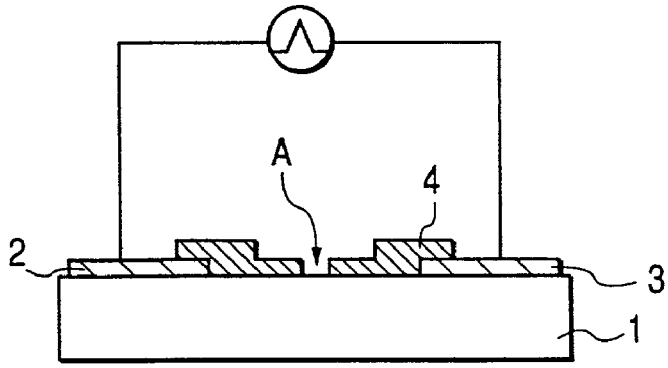
FIGS. 20M and 20N are process drawings describing the method for manufacturing the electron emission element according to this invention.
Figure 20N:
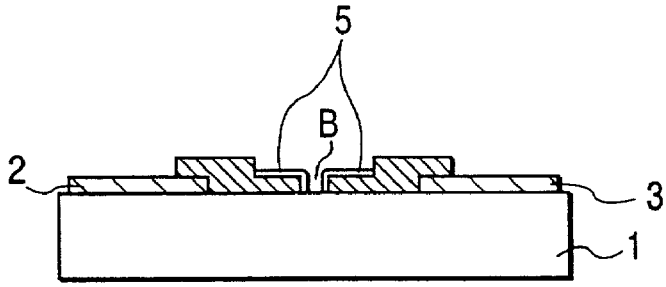

FIG. 16 is an image drawing showing an example of a panel structure of an image forming apparatus comprising the electron source in the ladder type arrangement. Reference numeral 120 designates a grid electrode, 121 is an aperture through which electrons pass, $D_{0x1}$ to $D_{0xm}$ are extra-chamber terminals, and $G_1$ to $G_n$ are extra-chamber terminals connected to the grid electrodes 120. Reference numeral 110 denotes an electron source substrate in which the common wires among the respective element rows are identical. In FIG. 16, the same sites as shown in FIGS. 12 and 15 have the same reference numerals. A major difference between this apparatus and the image forming apparatus in the simple matrix arrangement shown in FIG. 12 is the presence of the grid electrodes 120 between the electron source substrate 110 and the face plate 86.

In FIG. 16, the grid electrodes 120 are provided between the substrate 110 and the face plate 86. The grid electrode 120 modulates electron beams emitted from the electron emission elements 111 and includes the circular apertures 121 corresponding to the respective elements in order to pass electron beams through the electrodes arranged in a stripe so as to be orthogonal to the element rows in the ladder type arrangement. The shapes and locations of the grid electrodes are not limited to those shown in FIG. 16. For example, a large number of passage openings may be provided in a mesh as the apertures or the grid electrodes may be provided around or near the respective electron emission elements.

The extra-chamber terminals $D_{0x1}$ to $D_{0xm}$ and the extra-chamber grid terminals $G_1$ to $G_n$ are electrically connected to the controlling circuit (not shown).

In the image forming apparatus according to this example, a modulated signal for one image line is simultaneously applied to the grid electrode columns in synchronism with the sequential driving (scanning) of each element row. This operation can control the irradiation of the phosphors with each electron beam to display the image one line at a time.

The image forming apparatus described above can be used not only as a display for television broadcasting, a television conference system, or a computer but also as an optical printer configured using a photosensitive drum.

This invention will be described below in detail with reference to embodiments.

EMBODIMENT 1

In this embodiment, the electron emission elements having the configuration shown in FIG. 1 were produced using the method for manufacturing the element according to this invention.

The method for manufacturing the electron emission element according to this embodiment will be explained in the order of the processes with reference to FIGS. 17A to 17D and FIGS. 18E to 18H and FIGS. 19I to 19L and FIGS. 20M and 20N. The following processes (a) to (n) correspond to processes (a) to (n) in FIGS. 17A to 17D, FIGS. 18E to 18H, FIGS. 19I to 19L and FIGS. 20M and 20N.

Process (a)

A quartz substrate was used as the insulating substrate 1 and was sufficiently washed in a detergent, pure water, and an organic solvent. A spinner was used to apply a resist material (RD-2000 N; manufactured by Hitachi Kasei Co., Ltd.) at 2,500 rpm for 40 seconds, and the resist was then heated at 80° C. for 25 minutes for prebaking.

Process (b)

A mask corresponding to an element electrode shape having an electrode interval L of 2 μm and an electrode length W of 500 pm was used to be in contact with the resist.

The resist was exposed and was developed using an RD-2000N developer. Then, the resist was heated at 120° C. for 20 minutes for postbaking.

Process (c)

Nickel metal was used as the material of the electrodes. A resistance heating depositing machine was used to deposit nickel at 0.3 nm per second until the thickness became 100 nm.

Process (d)

Acetone was used to execute liftoff, and the nickel layer was washed in acetone, isopropyl alcohol, and butyl acetate in this order. The nickel layer was then dried and the element electrodes 2 and 3 were formed.

Process (e)

Cr was deposited all over the surface (thickness: 40 nm).

Process (f)

A spinner was used to apply a resist material (AZ1370; manufactured by Hoechst Co., Ltd.) at 2,500 rpm for 30 seconds, and the resist was then heated at 90° C. for 30 minutes for prebaking.

Process (g)

A resist having a pattern with which a conductive film material was applied was used to execute exposure.

Process (h)

The resist was developed using a developer MIF312 and was then heated at 120° C. for 30 minutes for postbaking.

Process (i)

The substrate was immersed in a solution having a composition of $(NH_4)Ce(NO_3)_6/HClO_4/H_2O$=17-g/5 cc/100 cc to etch chromium.

Process (j)

The substrate was ultrasonic-agitated in acetone for 10 minutes to remove the resist.

Process (k)

A spinner was used to apply ccp4230 (Okuno Seiyaku Inc.) at 800 rpm for 30 seconds, and the layer was baked at 300° C. for 10 minutes to form the fine particle-like conductive film 4 mainly consisting of fine particles (average particle: 7 nm) of palladium oxide (PdO).

Process (l)

The chromium was lifted off in such a way that the conductive film 4 having a predetermined shape is located nearly at the center between the element electrodes 2 and 3. The conductive film 4 had a thickness of 10 nm and a resistance value $R_s=5\times10^4$ Ω/□.

Process (m)

The elements produced in this manner were installed in the measuring and evaluating apparatus in FIG. 9, which was then exhausted using the vacuum pump. Once the vacuum reached $2.6\times10^{-5}$ Pa, the power supply 51 for applying the element voltage $V_f$ was used to apply the voltage to each of the element electrodes 2 and 3 for conductive processing (forming). According to this embodiment, the forming was executed by applying the voltage waveform shown in FIG. 4(B) (but not a chopping wave but a rectangular wave), setting a pulse width $T_1$ and a pulse interval $T_2$ at 1 msec. and 10 msec., respectively, and increasing the peak value of the rectangular wave (the peak value during the forming) at a 0.1-V process. In addition, during the forming, a 0.1-V resistance measuring pulse was inserted into the pulse interval $T_2$ to measure the resistance. The forming was finished when the measured value obtained using the resistance measuring pulse reached about 1 MΩ or more, and the application of the voltage to the elements was simultaneously terminated. As a result, a crack A was formed in the conductive film 4.

The plurality of elements were similarly processed. A pulse voltage $V_f$ at the end of forming was about 5.0 V for all elements.

Process (n)

After the elements were produced in this manner, toluene (dipole moment: 0.36 Debye) was introduced into the vacuum chamber 55 of the apparatus in FIG. 9 at the room temperature so as to have a partial pressure of $1.3\times10^{-4}$ Pa.

To introduce the toluene, an ampule (not shown) retaining it was connected to the gas introducing port provided in the vacuum chamber 55 in FIG. 9 as shown in FIG. 8. When the toluene was vaporized from the ampule, the water adsorbing filter removed moisture from this gas. Then, the opening of the slow leak (needle) valve was adjusted to control the flow rate of the gas flowing through the chamber. The partial pressure of water in the atmosphere in the vacuum chamber in which the toluene was introduced was measured using the quadruple mass spectrometer connected to the chamber. The measured value was $2.3\times10^{-4}$ Pa.

A voltage was then applied between the element electrodes for activation. The voltage waveform used for the activation was a dipole rectangular wave (applied equally in both the forward and backward directions) having a peak value of ±10 V, a pulse width of 100 μsec., and a pulse interval of 5 msec. Subsequently, the peak value of the rectangular wave was gradually increased at 3.3 mV/sec. from ±10 V to ±14 V, and the application of the voltage was finished when the value reached ±14 V. At this point, the element current value was 8 mA. Finally, the toluene was exhausted.

The carbon film 5 was formed on the conductive film 4 and inside the crack A in the film 4.

Furthermore, the following stabilization process was executed.

The elements and the vacuum chamber 55 were heated at 200° C. for 10 hours to set the vacuum in the vacuum chamber 55 at $1.3\times10^{-6}$ Pa.

Subsequently, the characteristics of the elements obtained in this manner were measured using an apparatus configured as shown in FIG. 9.

Specifically, at the vacuum of $1.3\times10^{-6}$ Pa, the voltage of the anode electrode 54 was measured at 1 kV and the distance H between the anode electrode 54 and the electron emission element was measured at 4 mm. The elements were driven by applying a voltage of +13.5 V to provide a rectangular wave of pulse width 0.1 msec. and frequency 60 Hz.

At one minute after the start of the measurements, an element current $I_{f0}$ was 5.5 mA, an emission current $I_{e0}$ was 5.5 μA, and an electron emission efficiency η was 0.10%.

In addition, after driving for a predetermined period of time, the element current $I_f$ was 3.5 mA, the emission current $I_e$ was 3.5 μA, and the electron emission efficiency η was 0.10%. The residual rates $\delta_f$ and $\delta_e$ of the element and emission currents were both 64%.

The residual rates $\delta_f$ and $\delta_e$ of the element and emission currents were defined as follows:

$$\delta_f=I_f/I_{f0}\times100(\%)$$

$$\delta_e=/I_{e0}\times100(\%)$$

EMBODIMENT 2

The elements for which processes (a) to (m) were executed as in Embodiment 1 were subjected to the following process (n).

Process (n)

Pyridine (dipole moment: 2.2 Debye) was introduced at the room temperature so as to have a partial pressure of $1.3\times10^{-4}$ Pa. In this process, the pyridine was introduced after passing through the water adsorbing filter to remove moisture from the pyridine gas, as in Embodiment 1. The partial pressure of water in the vacuum chamber with the pyridine introduced therein was $3.0\times10^{-4}$ Pa. Then, a voltage was applied between the element electrodes for activation. The voltage application condition was similar to that in Embodiment 1. The element current value reached during the activation process was 7.5 mA.

In addition, the carbon film 5 was formed on the conductive film 4 and inside the crack A in the film 4.

The processes subsequent to the activation were carried out in the same manner as in Embodiment 1, and the characteristics of the electron emission elements obtained were evaluated.

At one minute after the start of the measurements, the element current $I_{f0}$ was 6.0 mA, the emission current $I_{e0}$ was 7.5 μA, and an electron emission efficiency η was 0.125%.

In addition, after driving for a predetermined period of time, the element current $I_f$ was 3.8 mA, the emission current $I_e$ was 4.5 μA, and the electron emission efficiency η was 0.12%. The residual rates $\delta_f$ and $\delta_e$ of the element and emission currents were 63% and 60%, respectively.

EMBODIMENT 3

The elements for which processes (a) to (m) were executed as in Embodiment 1 were subjected to the following process (n).

Process (n)

Benzonitrile (dipole moment: 3.9 Debye) was introduced at the room temperature so as to have a partial pressure of $1.3\times10^{-4}$ Pa. In this process, the benzonitrile was introduced after passing through the water adsorbing filter to remove moisture from the benzonitrile gas, as in Embodiment 1. The partial pressure of water in the vacuum chamber with the benzonitrile introduced therein was $2.1\times10^{-4}$ Pa. Then, a voltage was applied between the element electrodes for activation. The voltage application condition was similar to that in Embodiment 1. The element current value reached during the activation process was 7.3 mA.

In this embodiment, the carbon film was also formed on the conductive film 4 and inside the crack A in the film 4.

The processes subsequent to the activation were carried out in the same manner as in Embodiment 1, and the characteristics of the electron emission elements obtained were evaluated.

One minute after the start of the measurements, the element current $I_{f0}$ was 6.5 mA, the emission current $I_{e0}$ was 8.5 μA, and an electron emission efficiency η was 0.131%.

In addition, after driving for a predetermined period of time, the element current $I_f$ was 4.6 mA, the emission current $I_e$ was 5.7 μA, and the electron emission efficiency η was 0.12%. The residual rates $\delta_f$ and $\delta_e$ of the element and emission currents were 71% and 67%, respectively.

REFERENCE EXAMPLE 1

The elements for which processes (a) to (m) were executed as in Embodiment 1 were subjected to the following process (n).

Process (n)

n-hexane (dipole moment: 0 Debye) was introduced at the room temperature so as to have a partial pressure of $1.3\times10^{-2}$ Pa. In this process, the n-hexane was introduced after passing through the water adsorbing filter to remove moisture from the n-hexane gas, as in Embodiment 1. The partial pressure of water in the vacuum chamber with the n-hexane introduced therein was $1.0\times10^{-3}$ Pa. Then, a voltage was applied between the element electrodes for activation. The voltage application condition was similar to that in Embodiment 1. The element current value reached during the activation process was 8 mA.

In this reference example, the carbon film 5 was also formed on the conductive film 4 and inside the crack A in the film 4.

The processes subsequent to the activation were carried out in the same manner as in Embodiment 1, and the characteristics of the electron emission elements obtained were evaluated.

At one minute after the start of the measurements, the element current $I_{f0}$ was 2 mA, the emission current $I_{e0}$ was 1.5 μA, and an electron emission efficiency η was 0.075%.

In addition, after driving for a predetermined period of time, the element current $I_f$ was 0.6 mA, the emission current $I_e$ was 0.5 μA, and the electron emission efficiency η was 0.08%. The residual rates $\delta_f$ and $\delta_e$ of the element and emission currents were 30% and 33%, respectively.

REFERENCE EXAMPLE 2

The elements for which processes (a) to (m) were executed as in Embodiment 1 were subjected to the following process (n).

Process (n)

Benzene (dipole moment: 0 Debye) was introduced at the room temperature so as to have a partial pressure of $1.3\times10^{-3}$ Pa. In this process, the benzene was introduced after passing through the water adsorbing filter to remove moisture from the benzene gas, as in Embodiment 1. The partial pressure of water in the vacuum chamber with the benzene introduced therein was $5.0\times10^{-4}$ Pa. Then, a voltage was applied between the element electrodes for activation. The voltage application condition was similar to that in Embodiment 1. The element current value reached during the activation process was 7.3 mA.

In this reference example, the carbon film 5 was also formed on the conductive film 4 and inside the crack A in the film 4.

The processes subsequent to the activation were carried out in the same manner as in Embodiment 1, and the characteristics of the electron emission elements obtained were evaluated.

One minute after the start of the measurements, the element current $I_{f0}$ was 4.5 mA, the emission current $I_{e0}$ was 3.1 μA, and an electron emission efficiency was 0.069%.

In addition, after driving for a predetermined period of time, the element current $I_f$ was 2.0 mA, the emission current $I_e$ was 1.2 μA, and the electron emission efficiency η was 0.06%. The residual rates $\delta_f$ and $\delta_e$ of the element and emission currents were 44% and 39%, respectively.

According to Embodiments 1 to 3 and Reference Examples 1 and 2 described above, by executing the activation process in the atmosphere containing the aromatic compound having a polarity or a polar group, electron emission elements emitting a large amount of electrons and subjected to little temporal degradation can be obtained despite the subsequent stabilization process.

EMBODIMENT 4

According to this embodiment, a ladder-type electron source configured as shown in FIG. 15 was used to produce an image display apparatus configured as shown in FIG. 16.

A manufacturing method similar to that in Embodiment 1 was used to produce on the electron source substrate 110 a plurality of element columns each comprising a plurality of elements each including the conductive film between the pair of element electrodes, the elements being connected between the pair of wiring electrodes 112. Then, the electron source substrate 110 was fixed to the rear plate 81, and the grid electrodes 120 each having the electron passage holes 121 therein were placed above the electron source substrate 110 in the direction orthogonal to the wiring electrodes 112. Furthermore, the face plate 86 (comprising the glass substrate 83 and the fluorescent screen 84 and metal back 85 in the inner surface of the substrate 83; see FIG. 12) was placed 5 mm above the electron source substrate 110 via the supporting frame 82, and frit glass was applied to the junctions between the face plate 86 and the supporting frame 82 and the rear plate 81 and was baked in the air at 410° C. for 10 minutes or longer for sealing. Frit glass was also used to fix the electron source substrate 110 to the rear plate 81.

The fluorescent screen 84 comprised a color fluorescent screen in the black stripe arrangement composed of the black conductive materials 91 and the phosphors 92 (FIG. 13A). The black stripe was first formed, and each of the color phosphors was then applied to the gaps in the stripe to form the fluorescent screen 84. The slurry method was used to coat the phosphors on the glass substrate.

In addition, the metal back 85 was provided in the inner surface of the fluorescent screen 84. The metal back 85 was produced after the production of the fluorescent screen by smoothening (normally called "filming") the inner surface of the screen and then depositing Al thereon under vacuum.

Sufficient alignment was executed during the above sealing because for the color fluorescent screen, each color phosphors must correspond to the respective element.

Figure 26:
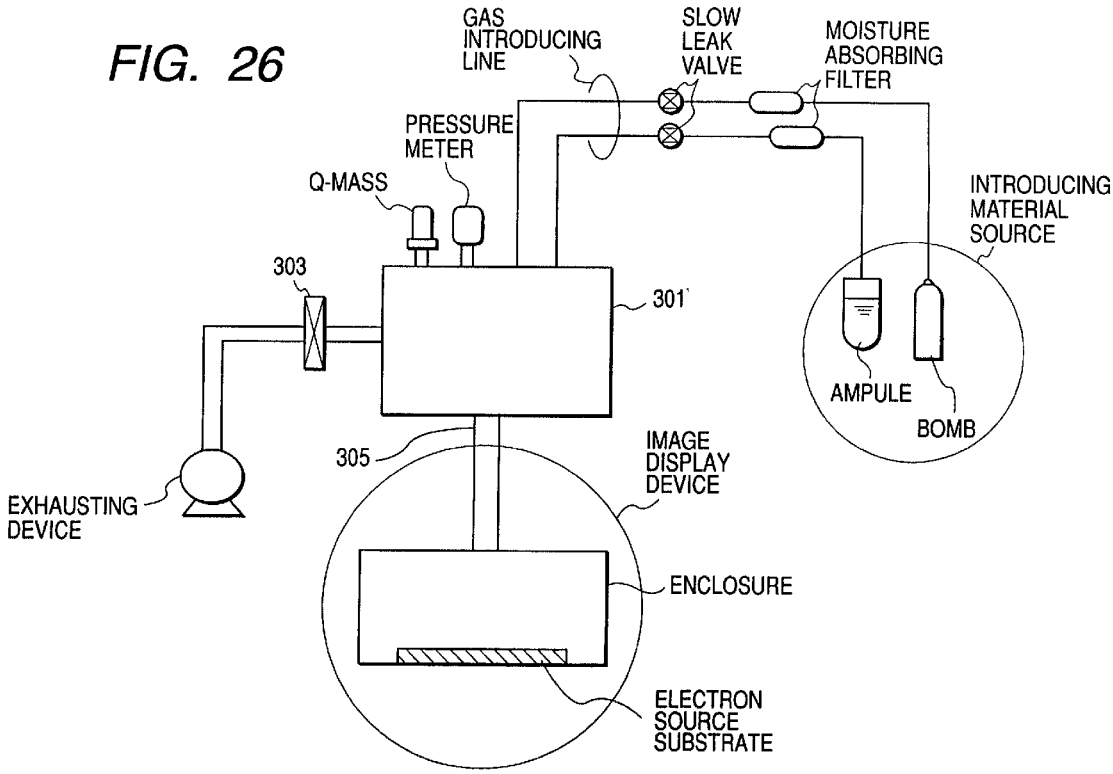
FIG. 26 is a schematic block diagram of a vacuum apparatus for an activation process according to Embodiments 4 and 5.

The forming process and the subsequent processes were executed for the glass chamber (enclosure) completed in the above manner, using the evacuation apparatus shown in FIG. 26.

As shown in FIG. 26, to exhaust the inside of the enclosure, the vacuum chamber and the enclosure were connected together via one exhaust pipe. Then the inside of the enclosure was exhausted using an exhausting device composed of a magnetic levitation turbo pump connected to the vacuum chamber.

Once a sufficient vacuum was reached, a voltage was applied between the element electrodes through the extra-chamber terminals $D_{0x1}$ to $D_{0xm}$, and the forming was executed to form a crack in each conductive film between the electrodes in order to form an electron emission section in the film.

Then, gas evaporated from an ampule having benzonitrile (dipole moment: 3.9 Debye) inside was introduced into the vacuum chamber and the glass chamber (the enclosure) via the water adsorbing filter and the slow leak (needle) valve. The pressure of the benzonitrile was about $1.3\times10^{-3}$ Pa, and the partial pressure of water, which was measured using the quadruple mass spectrometer (Q-Mass) connected to the vacuum chamber, was $5.0\times10^{-3}$ Pa.

Then, a voltage was applied between the element electrodes through the extra-chamber terminals $D_{0x1}$ to $D_{0xm}$ to carry out the activation process. The voltage application condition for the activation process was similar to that in Embodiment 1.

Subsequently, the benzonitrile was exhausted.

The carbon film was formed on the conductive film and inside the crack in the conductive film.

Finally, after, as the stabilization process, baking was carried out in a vacuum of about $1.3\times10^{-4}$ Pa at 150° C. for 10 hours, a voltage was applied as in Embodiment 1 (in the forward direction) and a gas baker was used to heat and weld the exhaust pipe in order to seal the enclosure.

In the image display apparatus according to this embodiment completed in the above manner, a voltage was applied to each electron emission element through the extra-chamber terminals $D_{0x1}$ to $D_{0xm}$ (in the forward direction) to cause electrons to be emitted therefrom. After passing through the electron passage holes 121 in the grid electrodes 120, emitted electrons were accelerated by a high voltage of several kV or more applied to the metal back or the transparent electrode (not shown) through the high-voltage terminals 87. The electrons then collided against the fluorescent screen 84, which then excited to emit light. In this case, by applying a voltage corresponding to an information signal, to the grid electrodes 120 through the extra-chamber terminals $G_1$ to $G_n$, electron beams passing through the electron passage holes 121 were controlled to display an image.

According to this embodiment, the grid electrode 120 having the electron passage holes 121 of 50 μm diameter were placed 10 μm above the electron source substrate 110 via $SiO_2$ (not shown) that was an insulating layer. Thus, when the acceleration voltage of 6 kV was applied, the turn-on and -off of electron beams could be controlled using the modulation voltage lower than or equal to 50 V.

In addition, the displayed image had a good contrast, which remained unchanged despite several hours of display.

EMBODIMENT 5

According to this embodiment, an electron source in the simple matrix arrangement configured as shown in FIG. 11 was used to produce an image display apparatus configured as shown in FIG. 12.

Figure 21:
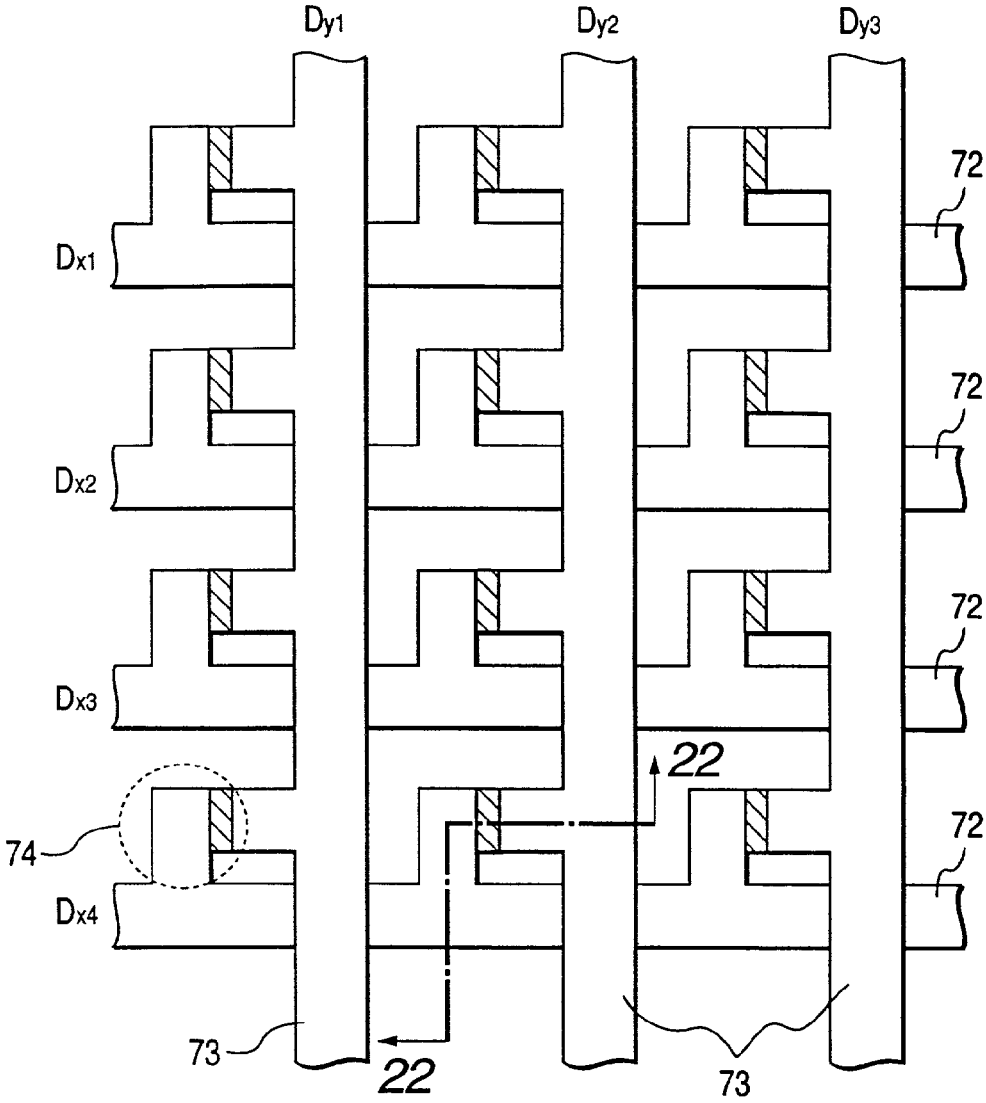
FIG. 21 is an image drawing showing part of an electron source substrate having matrix connections according to Embodiments 5 and 11.
Figure 22:
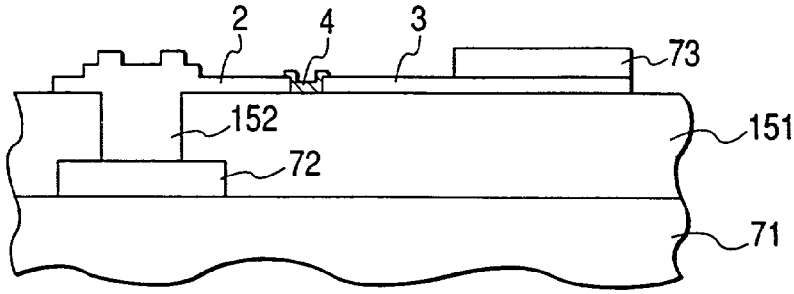
FIG. 22 is a pictorial sectional view taken along line 22—22 in FIG. 21.
Figure 23A:
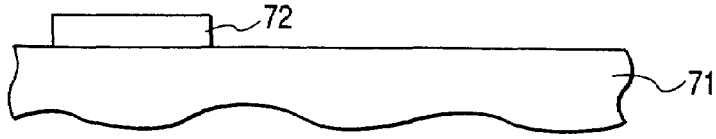
FIGS. 23A, 23B, 23C and 23D are manufacturing process drawings for the electron source in FIG. 21.
Figure 23B:
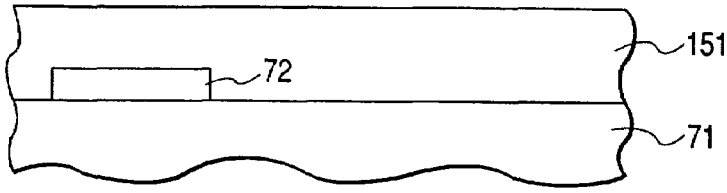
Figure 23C:
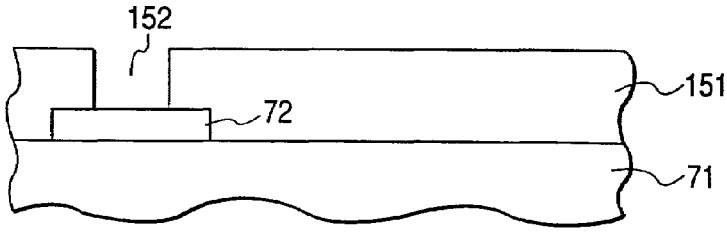
Figure 23D:
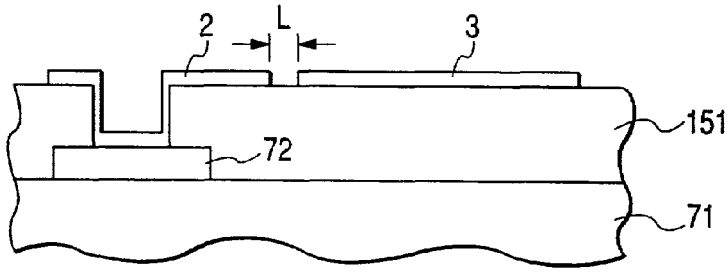
Figure 24E:
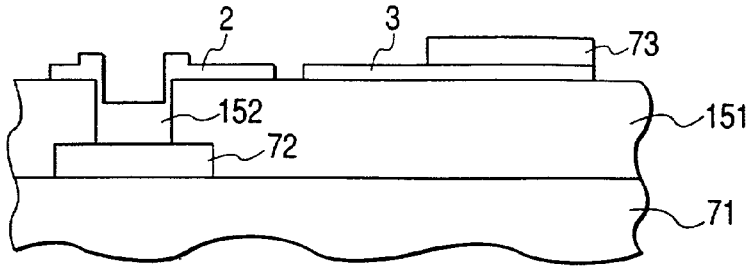
FIGS. 24E, 24F, 24G and 24H are manufacturing process drawings for the electron source in FIG. 21.
Figure 24F:
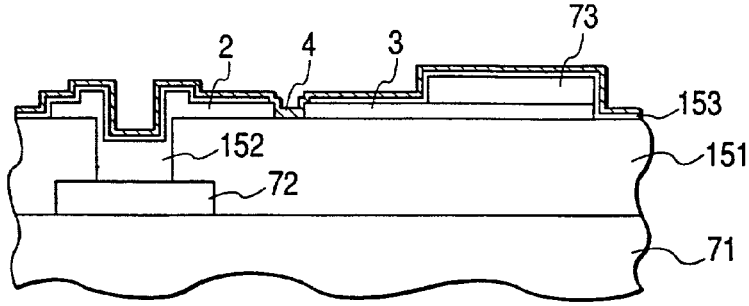
Figure 24G:
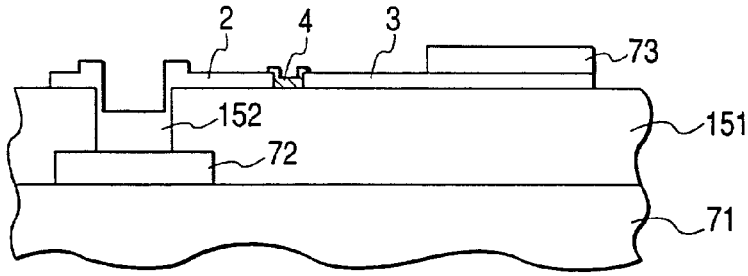
Figure 24H:
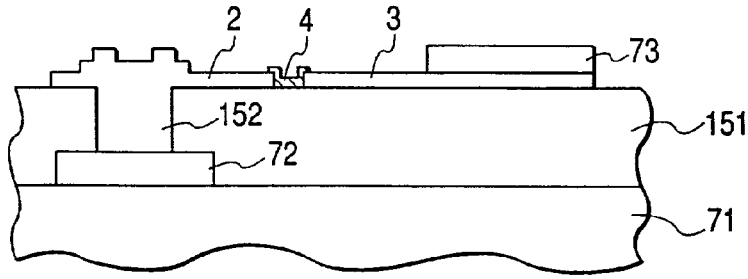

FIG. 21 is a plan view of part of an electron source substrate according to this embodiment comprising a plurality of elements that each include a conductive film between a pair of element electrodes and that are connected together in a matrix. FIG. 22 shows a sectional view taken along 22—22 in FIG. 21. Each of the components having the same reference numerals in FIGS. 11, 12, 21, and 22 is the same. In these figures, 72 is an X-direction wiring (also referred to as a "lower wiring") corresponding to $D_{xn}$ in FIG. 11, 73 is a Y-direction wiring (also referred to as an "upper wiring") corresponding to $D_{yn}$ in FIG. 11, 4 is a conductive film including an electron emission section, 2 and 3 are element electrodes, 151 is an interlayer insulating layer, and 152 is a contact hole used to electrically connect the element electrode 2 and the lower wiring 72 together.

First, the method for manufacturing the electron source substrate will be specifically described with reference to FIGS. 23A to 23D and FIGS. 24E to 24H in the order of the processes. The following processes (a) to (h) correspond to (a) to (h) in FIGS. 23A to 23D and FIGS. 24E to 24H.

Process (a)

Vacuum deposition was used to sequentially laminate Cr of thickness 50 angstrom units and Au of thickness 6,000 angstrom units on the substrate 71 comprising a purified soda-lime glass plate and a silicon oxide film of thickness 0.5 μm formed thereon using the sputtering method. A photo resist (AX1370/Hoechst Co., Ltd.) was rotationally applied using a spinner and was then baked. Subsequently, a photo mask image was exposed and developed to form a resist pattern of the lower wiring 72, and the Au/Cr deposited film was wet-etched to form the lower wiring 72 of a desired shape.

Process (b)

Then, the interlayer insulating layer 151 consisting of a silicon oxide film of thickness 1.0 μm was deposited using the RF sputtering method.

Process (c)

A photo resist pattern was produced in order to form the contact hole 152 in the silicon oxide film deposited at process (b). This pattern was used as a mask to etch the interlayer insulating layer 151 in order to form the contact hole 152. This etching was based on the RIE (Reactive Ion Etching) Method using $CH_4$ and $H_2$ gas.

Process (d)

A photo resist (RD-2000N-41 manufactured by Hitachi Kasei Co., Ltd.) was used to form a pattern that constituted a gap L between the element electrodes 2 and 3, and Ti of thickness 50 angstrom units and Ni of thickness 1,000 angstrom units were sequentially deposited using the vacuum deposition method. The photo resist pattern was dissolved using an organic solvent to lift off the Ni/Ti deposited film. In this manner, the element electrodes 2 and 3 were formed that had an element electrode interval L of 3 μm and an element electrode width W of 300 μm.

Process (e)

After a photo resist pattern of the upper wiring 73 was formed on the element electrode 3, Ti of 50 angstrom units thickness and Au of 5,000 angstrom units thickness were sequentially deposited thereon and unwanted portions were removed by means of liftoff to form the upper wiring 73 of a desired shape.

Process (f)

A Cr film 153 of 1,000 angstrom units thickness was deposited and patterned using vacuum deposition, and organic Pd (ccp4230 manufactured by Okuno Seiyaku Co., Ltd.) was coated thereon using a spinner. Then, heating and baking processing was executed at 300° C. for 10 minutes.

Process (g)

The Cr film 153 was etched using an acid etchant and lifted off to form the conductive film 4 having a desired pattern.

Process (h)

A pattern was formed that allowed a resist to be applied to all portions other than the contact hole 152, and Ti of 50 angstrom units thickness and Au of 5,000 angstrom units thickness were sequentially deposited thereon using vacuum deposition. Unwanted portions were removed by means of liftoff to bury the contact hole 152.

These processes were executed to form the lower wiring 72, the interlayer insulating layer 151, the upper wiring 73, the element electrodes 2 and 3, and the conductive film 4 on the insulating substrate 71.

Then, an image display apparatus was produced using the electron source substrate 71 produced in the above manner and comprising the plurality of conductive films 4 connected together in a matrix. The production procedure will be explained with reference to FIGS. 12, 13A and 13B.

First, the electron source substrate 71 comprising the plurality of conductive films 4 connected together in a matrix was fixed to the rear plate 81. Then, the face plate 86 (comprising the glass substrate 83 and the fluorescent screen 84 and metal back 85 in the inner surface of the substrate 83) was placed 5 mm above the substrate 71 via the supporting frame 82, and frit glass was applied to the junctions between the face plate 86 and the supporting frame 82 and the rear plate 81 and was baked in the air at 410° C. for 10 minutes or longer for sealing to produce the enclosure 88 (FIG. 12). Frit glass was also used to fix the substrate 71 to the rear plate 81.

The fluorescent screen 84 comprised a color fluorescent screen in the black stripe arrangement composed of the black conductive materials 91 and the phosphors 92 (FIG. 13A). The black stripe was first formed, and each of the color phosphors was then applied to the gaps in the stripe to form the fluorescent screen 84, using the slurry method.

In addition, the metal back 85 was provided in the inner surface of the fluorescent screen 84. The metal back 85 was produced after the production of the fluorescent screen 84 by smoothening the inner surface of the screen 84 and then depositing Al thereon under vacuum.

Sufficient alignment was executed during the above sealing because for the color fluorescent screen, each color phosphor must correspond to the respective element.

The enclosure 88 completed as described above was exhausted as in Embodiment 4 using the evacuation apparatus shown in FIG. 26, until the vacuum became about $1.3\times10^{-4}$ Pa. Subsequently, a voltage was applied between the element electrodes 2 and 3 of each of the plurality of elements 74 connected together in a matrix, through the extra-chamber terminals $D_{0x1}$, to $D_{0xm}$, and $D_{0y1}$ to $D_{0ym}$ to subject the conductive films 4 to conductive processing (forming). Thus, a crack was formed in each conductive film 4 between the element electrodes 2 and 3 to form the electron emission section 5 in each film 4.

Figure 25:
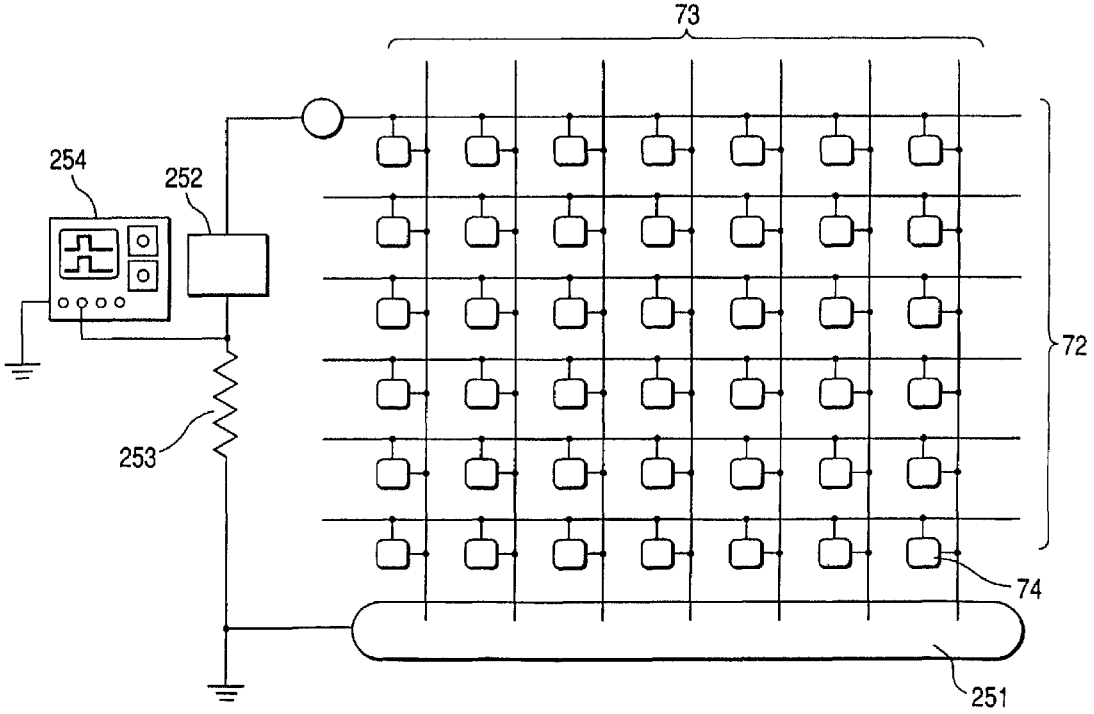
FIG. 25 describes a forming process according to Embodiments 5 and 10.

Specifically, as shown in FIG. 25, the Y-direction wiring 73 was connected to the common electrode 251, and the forming was carried out by simultaneously applying a voltage pulse similar to that in Embodiment 1 to the plurality of elements using a power supply 252 connected to one of the X-direction wires 72. The plurality of elements connected to the X-direction wiring can be simultaneously formed by sequentially applying (scrolling) pulses, each having an offset phase, to the plurality of X-direction wires. In FIG. 25, 253 is a current measuring resistor and 254 is a current measuring oscilloscope.

The electron emission section 5 produced in this manner contained fine particles dispersed therein and mainly consisting of palladium elements, and the fine particle had an average particle size of 30 angstrom units.

Then, benzonitrile (dipole moment: 3.9 Debye) was introduced into the enclosure 88 so as to have a partial pressure of about $1.3\times10^{-3}$ Pa. The benzonitrile was introduced as in Embodiment 4 using the evacuation apparatus shown in FIG. 26. The partial pressure of water, which was measured using the quadruple mass spectrometer (Q-Mass) connected to the vacuum chamber, was $5.0\times10^{-3}$ Pa. Then, a voltage was applied between the element electrodes 2 and 3 of each element 74 through the extra-chamber terminals $D_{0x1}$, to $D_{0xm}$ and $D_{0y1}$ to $D_{0ym}$ to carry out the activation process. The voltage application condition for the activation process was similar to that in Embodiment 1. Subsequently, the benzonitrile was exhausted. The carbon film was formed on the conductive film and inside the crack in the film.

Finally, after, as the stabilization process, baking was carried out in a vacuum of about $1.3\times10^{-4}$ Pa at 150° C. for 10 hours, a voltage was then applied as in Embodiment 1 (in the forward direction) and a gas baker was used to heat and weld the exhaust pipe in order to seal the enclosure 88.

In the image display apparatus according to this embodiment completed in the above manner, a signal generating means (not shown) applied a scanning signal and a modulated signal to each electron emission element through the extra-chamber terminals $D_{0x1}$ to $D_{0xm}$ and $D_{0y1}$ to $D_{0ym}$ to cause electrons to be emitted therefrom. Then, a high voltage of several kV or more was applied to the metal back 85 or the transparent electrode (not shown) through the high-voltage terminals 87 to accelerate emitted electrons in order to allow them to collide against the fluorescent screen 84. Thus, the screen was excited to emit light to display an image.

As a result, the displayed image had a good contrast, which remained unchanged despite several hours of display.

EMBODIMENT 6

The elements for which process (a) to process (m) had been executed were subjected to the following process (n).

Process (n)

For these elements, benzonitrile was introduced through a mass filter at the room temperature so as to have a partial pressure of about $1.3\times10^{-4}$ Pa. The benzonitrile was introduced as in Embodiment 1 except for the use of the mass filter instead of the water adsorbing filter. The partial pressure of water in the vacuum chamber with the benzonitrile introduced therein was measured using the quadruple mass spectrometer. The measured value was $1.3\times10^{-5}$ Pa, which was 10% of the partial pressure of the benzonitrile. Next, a voltage was applied between the element electrodes for activation.

The voltage waveform used for the activation was a dipole rectangular wave (applied equally in both the forward and backward directions) having a peak value of ±10 V, a pulse width of 100 μsec., and a pulse interval of 5 msec. Subsequently, the peak value of the rectangular wave was gradually increased at 3.3 mV/sec. from ±10 V to ±14 V, and the application of the voltage was finished when the value reached ±14 V. At this point, the element current value was 8 mA. Finally, the benzonitrile was exhausted.

In this embodiment, the carbon film was formed on the conductive film and inside the crack in the film.

The processes subsequent to the activation were carried out in the same manner as in Embodiment 1, and the characteristics of the electron emission elements obtained were evaluated.

One minute after the start of the measurements, the element current $I_{f0}$ was 5.5 mA, the emission current $I_{e0}$ was 6.5 μA, and an electron emission efficiency η was 0.118%.

In addition, after driving for a predetermined period of time, the element current $I_f$ was 3.9 mA, the emission current $I_e$ was 4.2 μA, and the electron emission efficiency η was 0.108%. The residual rates $\delta_f$ and $\delta_e$ of the element and emission currents were 71% and 65%, respectively.

EMBODIMENT 7

In Embodiment 6, prior to the activation process, while evacuation is being executed, a path used to introduce an activated gas into the vacuum chamber in the measuring and evaluating apparatus in FIG. 9 and the vacuum chamber shown in FIG. 8 was heated at 100° C. for 5 hours. After the evacuation, the vacuum measured when the apparatus was cooled down to the room temperature was $2.6\times10^{-6}$ Pa. As in Embodiment 6, benzonitrile was introduced and the activation process was carried out. When the atmosphere during the activation process was measured using the quadruple mass spectrometer, the partial pressure ratio of water to benzonitrile was 0.05.

In this embodiment, the carbon film was also formed on the conductive film and inside the crack in the film.

The processes subsequent to the activation were carried out in the same manner as in Embodiment 1, and the characteristics of the electron emission elements obtained were evaluated.

At one minute after the start of the measurements, the element current $I_{f0}$ was 5 mA, the emission current $I_{e0}$ was 7.5 μA, and an electron emission efficiency η was 0.15%.

In addition, after driving for a predetermined period of time, the element current $I_f$ was 4.4 mA, the emission current $I_e$ was 6.0 μA, and the electron emission efficiency η was 0.15%. The residual rates $\delta_f$ and $\delta_e$ of the element and emission currents were 76% and 69%, respectively.

EMBODIMENT 8

The elements for which process (a) to process (m) had been executed were subjected to the following process (n).

Process (n)

Benzonitrile was introduced at the room temperature so as to have a partial pressure of about $1.3\times10^{-4}$ Pa. In this process, the benzonitrile was introduced as in Embodiment 1 except for the use of a two-process mass filter instead of the water adsorbing filter. The partial pressure of water in the vacuum chamber with the benzonitrile introduced therein was measured using the quadruple mass spectrometer. The partial pressure ratio of water to benzonitrile was 0.001. Next, a voltage was applied between the element electrodes for activation. The voltage application condition was similar to that in Embodiment 6.

The processes subsequent to the activation were carried out in the same manner as in Embodiment 1, and the characteristics of the electron emission elements obtained were evaluated.

At one minute after the start of the measurements, the element current $I_{f0}$ was 5.9 mA, the emission current $I_{e0}$ was 7.8 μA, and an electron emission efficiency was 0.13%.

In addition, after driving for a predetermined period of time, the element current $I_f$ was 4.3 mA, the emission current $I_e$ was 6.0 μA, and the electron emission efficiency η was 0.14%. The residual rates $\delta_f$ and $\delta_e$ of the element and emission currents were 73% and 77%, respectively.

According to Embodiments 6 to 8, by setting the partial pressure ratio of the organic substance to water in the activated atmosphere at 100 or less, electron emission elements emitting a large amount of electrons and subjected to little temporal degradation can be obtained despite the subsequent activation process.

EMBODIMENT 9

According to this embodiment, a ladder-type electron source configured as shown in FIG. 15 was used to produce an image display apparatus configured as shown in FIG. 16.

A manufacturing method similar to that in Embodiment 1 was used to produce on the electron source substrate 110 a plurality of element columns each comprising a plurality of elements each including the conductive film between the pair of element electrodes, the elements being connected between the pair of wiring electrodes 112. Then, the electron source substrate 110 was fixed to the rear plate 81, and the grid electrodes 120 each having the electron passage holes 121 therein were placed above the electron source substrate 110 in the direction orthogonal to the wiring electrodes 112. Furthermore, the face plate 86 (comprising the glass substrate 83 and the fluorescent screen 84 and metal back 85 in the inner surface of the substrate 83; see FIG. 12) was placed 5 mm above the electron source substrate 110 via the supporting frame 82, and frit glass was applied to the junctions between the face plate 86 and the supporting frame 82 and the rear plate 81 and was baked in the air at 410° C. for 10 minutes or longer for sealing. Frit glass was also used to fix the electron source substrate 110 to the rear plate 81.

The fluorescent screen 84 comprised a color fluorescent screen in the black stripe arrangement composed of the black conductive materials 91 and the phosphors 92 (FIG. 13A). The black stripe was first formed, and each of the color phosphors was then applied to the gaps in the stripe to form the fluorescent screen 84. The slurry method was used to coat the phosphors on the glass substrate.

In addition, the metal back 85 was provided in the inner surface of the fluorescent screen 84. The metal back 85 was produced after the production of the fluorescent screen by smoothening the inner surface of the screen and then depositing Al thereon under vacuum.

Sufficient alignment was executed during the above sealing because for the color fluorescent screen, each color phosphor must correspond to the respective element.

The forming process and the subsequent processes were executed for the glass chamber (enclosure) completed in the above manner, using the evacuation apparatus shown in FIG. 5.

As shown in FIG. 5, to exhaust the inside of the enclosure, the vacuum chamber 32 and the enclosure 88 were connected together via one exhaust pipe 31. Then, the inside of the enclosure 88 was exhausted using the exhausting device 34 composed of a magnetic levitation turbo pump connected to the vacuum chamber 32.

Once a sufficient vacuum was reached, a voltage was applied between the element electrodes through the extra-chamber terminals $D_{0x1}$ to $D_{0xm}$, and the forming was executed to form a crack in each conductive film between the electrodes in order to form an electron emission section in the film.

Then, gas evaporated from an ampule having benzonitrile (dipole moment: 3.9 Debye) inside was introduced into the vacuum chamber 32 and the enclosure 88 via the mass filter 42 and the slow leak (needle) valve 38.

When the atmosphere in the chamber 32 was measured using the quadruple mass spectrometer connected to the vacuum chamber 32, the partial pressure ratio of water to benzonitrile was 0.017.

The voltage application condition for the activation process was similar to that in Embodiment 1. Subsequently, the benzonitrile was exhausted. The carbon film was formed on the conductive film and inside the crack in the conductive film.

Finally, after, as the stabilization process, baking was carried out in a vacuum of about $1.3\times10^{-4}$ Pa at 150° C. for 10 hours, a voltage was applied as in Embodiment 1 (in the forward direction), and a gas baker was used to heat and weld the exhaust pipe in order to seal the enclosure.

In the image display apparatus according to this embodiment completed in the above manner, a voltage was applied to each electron emission element through the extra-chamber terminals $D_{0x1}$ to $D_{0xm}$ (in the forward direction) to cause electrons to be emitted therefrom. After passing through the electron passage holes 121 in the grid electrodes 120, emitted electrons were accelerated by a high voltage of several kV or more applied to the metal back or the transparent electrode (not shown) through the high-voltage terminals 87. The electrons then collided against the fluorescent screen 84, which was excited to emit light. In this case, by applying a voltage corresponding to an information signal, to the grid electrodes 120 through the extra-chamber terminals $G_1$ to $G_n$, electron beams passing through the electron passage holes 121 were controlled to display an image.

According to this embodiment, the grid electrode 120 having the electron passage holes 121 of 50 μm diameter were placed 10 μm above the electron source substrate 110 via $SiO_2$ (not shown) that was an insulating layer. Thus, when the acceleration voltage of 6 kV was applied, the turn-on and -off of electron beams could be controlled using the modulation voltage lower than or equal to 50 V.

In addition, the displayed image had a good contrast, which remained unchanged despite several hours of display.

EMBODIMENT 10

According to this embodiment, an electron source in the simple matrix having an arrangement configured as shown in FIG. 11 was used to produce an image display apparatus configured as shown in FIG. 12.

Similar to that in embodiment 5, processes (a) to (h) were executed to form the lower wiring 72, the interlayer insulating layer 151, the upper wiring 73, the element electrodes 2 and 3, and the conductive film 4 on the insulating substrate 71.

Then, an image display apparatus was produced using the electron source substrate 71 produced in the above manner and comprising the plurality of conductive films 4 connected together in a matrix. The production procedure will be explained with reference to FIGS. 12, 13A and 13B.

First, the electron source substrate 71 comprising the plurality of conductive films 4 connected together in a matrix was fixed to the rear plate 81. Then, the face plate 86 (comprising the glass substrate 83 and the fluorescent screen 84 and metal back 85 in the inner surface of the substrate 83) was placed 5 mm above the substrate 71 via the supporting frame 82, and frit glass was applied to the junctions between the face plate 86 and the supporting frame 82 and the rear plate 81 and was baked in the air at 410° C. for 10 minutes or longer for sealing to produce the enclosure 88 (FIG. 12). Frit glass was also used to fix the substrate 71 to the rear plate 81.

The fluorescent screen 84 comprised a color fluorescent screen in the black stripe arrangement composed of the black conductive materials 91 and the phosphors 92 (FIG. 13A). The black stripe was first formed, and each of the color phosphors was then applied to the gaps in the stripe to form the fluorescent screen 84, using the slurry method.

In addition, the metal back 85 was provided in the inner surface of the fluorescent screen 84. The metal back 85 was produced after the production of the fluorescent screen 84 by smoothening the inner surface of the screen 84 and then depositing Al thereon under vacuum.

Sufficient alignment was executed during the above sealing because for the color fluorescent screen, each color phosphor must correspond to the respective element.

The enclosure 88 completed as described above was exhausted as in Embodiment 9 using the evacuation apparatus shown in FIG. 5, until the vacuum became about $1.3\times10^{-4}$ Pa. Subsequently, a voltage was applied between the element electrodes 2 and 3 of each of the plurality of elements 74 connected together in a matrix, through the extra-chamber terminals $D_{0x1}$ to $D_{0xm}$ and $D_{0y1}$ to $D_{0ym}$ to subject the conductive films 4 to conductive processing (forming) similar to that in embodiment 5. Thus, a crack was formed in each conductive film 4 between the element electrodes 4 to form the electron emission section 5 in each film 4.

The electron emission section 5 produced in this manner contained fine particles dispersed therein and mainly consisting of palladium elements, and the fine particles had an average particle size of 30 angstrom units.

Then, benzonitrile (dipole moment: 3.9 Debye) was introduced into the enclosure 88 so as to have a partial pressure of about $1.3\times10^{-3}$ Pa. The benzonitrile was introduced as in Embodiment 9 using the evacuation apparatus shown in FIG. 5. When the partial pressure of water in the vacuum chamber was measured using the quadruple mass spectrometer connected to the chamber, the partial pressure ratio of water to benzonitrile was 0.033. Next, a voltage was applied between the element electrodes 2 and 3 of each electron emission element 74 through the extra-chamber terminals $D_{0x1}$ to $D_{0xm}$ and $D_{0y1}$ to $D_{0ym}$ to carry out the activation process.

The voltage application condition for the activation process was similar to that in Embodiment 1.

Subsequently, the benzonitrile was exhausted.

The carbon film was formed on the conductive film and inside the crack in the film.

Finally, after, as the stabilization process, baking was carried out in a vacuum of about $1.3\times10^{-4}$ Pa at 150° C. for 10 hours, a voltage was then applied as in Embodiment 1 (in the forward direction) and a gas baker was used to heat and weld the exhaust pipe in order to seal the enclosure 88.

In the image display apparatus according to this embodiment completed in the above manner, a signal generating means (not shown) applied a scanning signal and a modulated signal to each electron emission element through the extra-chamber terminals $D_{0x1}$ to $D_{0xm}$ and $D_{0y1}$ to $D_{0ym}$ to cause electrons to be emitted therefrom. Then, a high voltage of several kV or more was applied to the metal back or the transparent electrode (not shown) through the high-voltage terminals 87 to accelerate emitted electrons in order to allow them to collide against the fluorescent screen 84. Thus, the screen was excited to emit light to display an image.

As a result, the displayed image had a good contrast, which remained unchanged despite several hours of display.

EMBODIMENT 11

Figure 27:
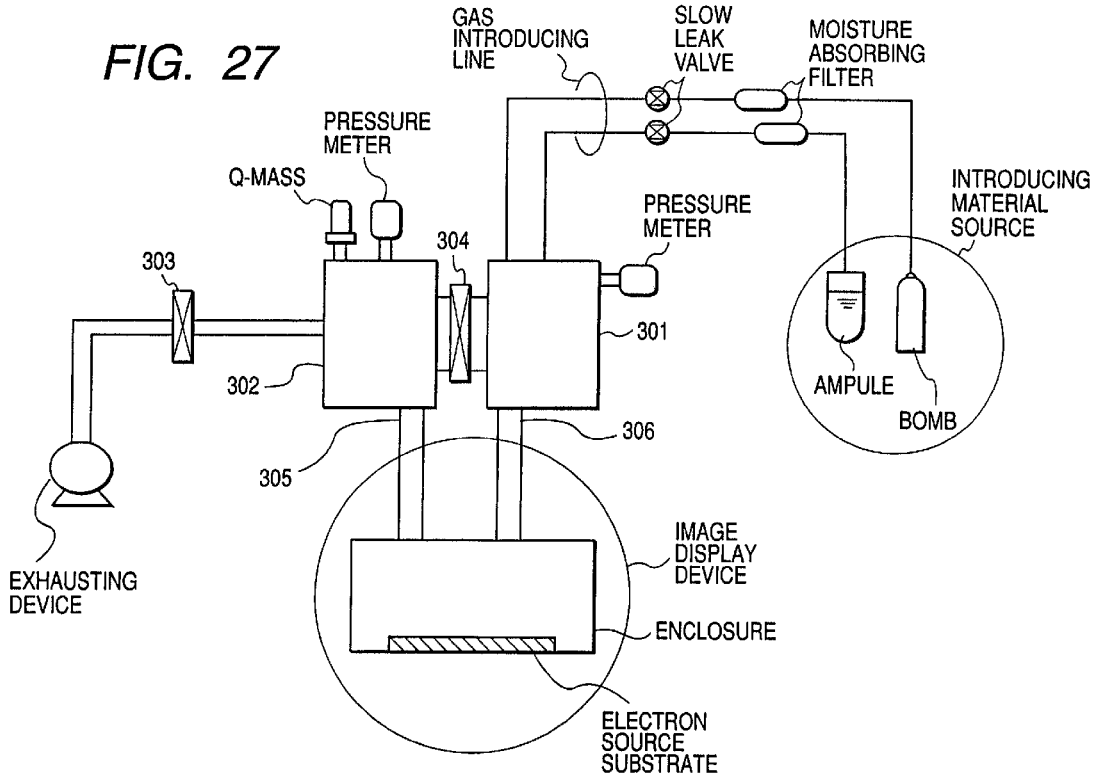
FIG. 27 is a schematic block diagram of a vacuum apparatus for an activation process according to Embodiment 11.

According to this embodiment, an image forming apparatus configured as shown in FIG. 12 was produced using an electron source in the simple matrix arrangement configured as shown in FIG. 11 and a vacuum evacuation apparatus shown in FIG. 27.

Processes (a) to (h) were carried out as in Embodiment 5 to form on the insulating substrate, the lower wiring, the interlayer insulating layers, the upper wiring, the element electrodes, and the conductive films. This insulating substrate was fixed inside the enclosure consisting of the face plate, the rear plate, supporting frame, and the exhaust pipe. The constituent members such as the fluorescent screen on the face plate and the production procedure were similar to those in Embodiment 5 except for the use of two exhaust pipes.

Next, two exhaust pipes 305 and 306 from the enclosure were connected to vacuum chambers 301 and 302 in FIG. 27, respectively. Gate valves 303 and 304 were opened, and this evacuation apparatus was used to exhaust the inside of the enclosure via the vacuum chambers 301 and 302. The pressure, which was measured using a pressure meter connected to the chambers 301 and 302, was about $1.3\times10^{-4}$ Pa. Subsequently, a voltage was applied between the element electrodes of each of the electron emission elements through the extra-chamber terminals $D_{0x1}$ to $D_{0xm}$ and $D_{0y1}$ to $D_{0ym}$ to subject the conductive films to the conductive processing (the forming) as in Embodiment 5, thereby forming a crack in each conductive film between the electrodes and thus an electron emission section in the film.

Next, the gate valve 304 was closed while the gate valve 303 was opened to exhaust the inside of the enclosure and the vacuum chambers 301 and 302 using the evacuation apparatus. Then, the slow leak (needle) valve was opened to introduce benzonitrile into the enclosure. The benzonitrile was retained in an ampule, and benzonitrile gas evaporated from the ampule was introduced into the vacuum chamber 301 via the water adsorbing chamber and the slow leak (needle) valve and then flowed to the enclosure and the chamber 302.

The opening of the slow leak (needle) valve was adjusted to maintain the benzonitrile introduction amount constant. The pressure in the vacuum chamber 301 was about $5.0\times10^{-3}$ Pa, and the pressure in the vacuum chamber 302 was $8.0\times10^{-4}$ Pa.

In addition, when the atmosphere was measured using the quadruple mass spectrometer (Q-Mass) connected to the vacuum chamber 302, the partial pressure ratio of water to benzonitrile was 0.08.

Next, a voltage was applied to activate between the element electrodes of each electron emission element through the extra-chamber terminals $D_{0x1}$ to $D_{0xm}$ and $D_{0y1}$ to $D_{0ym}$.

The voltage application condition for the activation process was similar to that in Embodiment 1. Then, the slow leak (needle) valve was closed while the gate valve 304 was opened to exhaust the benzonitrile. A carbon film was formed on the conductive film and inside a crack in the film.

Finally, as the activation process, baking was carried out in a vacuum of about $1.3\times10^{-4}$ Pa at 200° C. for 12 hours. A voltage was applied as in Embodiment 1 (in the forward direction), and a gas baker was used to heat and weld the two exhaust pipes to seal the enclosure.

In the image forming apparatus according to this invention completed in this manner, a signal generating means (not shown) applied a scanning signal and a modulated signal to each electron emission signal through the extra-chamber terminals $D_{0x1}$ to $D_{0xm}$ and $D_{0y1}$ to $D_{0ym}$ to allow electrons to be emitted therefrom. A high voltage of several kV or more was then applied to the metal back through the high-voltage terminal to accelerate electron beams. The beams then collided against the fluorescent screen, which was excited to emit light to display an image.

As a result, the displayed image had a good contrast, which remained unchanged despite several hours of display.

As described above, this invention can provide an electron emission element and an electron source that have a high electron emission efficiency.

In addition, this invention can provide an electron emission element and an electron source that are subject to very few temporal changes in electron emission characteristics by means of driving.

In addition, this invention can provide an electron emission element and an electron source that are subject to few temporal changes in emission current by means of driving.

In addition, this invention can provide an image forming apparatus that can form higher-grade images.

In addition, this invention can provide an image forming apparatus that can reduce the temporal decrease in illuminance and contrast.

What is claimed is:

1. A method of manufacturing an electron source comprising steps of:

exposing a surface of a substrate to a sealed atmosphere, on which surface a plurality of electron-emitting devices are to be formed, wherein the sealed atmosphere is formed by a chamber;

introducing a gas containing carbon into the sealed atmosphere;

depositing carbon on an electro-conductive member disposed on the surface of the substrate; and exhausting the gas containing carbon introduced into the sealed atmosphere during heating of the chamber, after the depositing of the carbon, wherein the chamber is heated before said introducing step, and wherein the introducing of the gas containing carbon is performed while exhausting the sealed atmosphere formed by the chamber.

2. A method of manufacturing an electron source comprising steps of:

exposing a surface of a substrate to a sealed atmosphere, on which surface a plurality of electron-emitting devices are to be formed, wherein the sealed atmosphere is formed by a chamber;

introducing a gas containing carbon into the sealed atmosphere;

depositing carbon on an electro-conductive member disposed on the surface of the substrate; and exhausting the gas containing carbon introduced into the sealed atmosphere during heating of the chamber, after the depositing of the carbon, wherein the chamber is heated before said introducing step, to reduce moisture absorbed to a surface of the chamber, and wherein the introducing of the gas containing carbon is performed while exhausting the sealed atmosphere formed by the chamber.

3. A method of manufacturing an electron source comprising steps of:

exposing a surface of a substrate to a sealed atmosphere, wherein an electron-emitting region is to be formed on the surface of the substrate, and wherein the sealed atmosphere is formed by a chamber;

introducing a gas containing carbon into the sealed atmosphere;

depositing carbon on an electro-conductive member disposed on the surface of the substrate; and exhausting the gas containing carbon introduced into the sealed atmosphere during heating of the chamber, after the depositing of the carbon, wherein the chamber is heated before said introducing step, and wherein the introducing of the gas containing carbon is performed while exhausting the sealed atmosphere formed by the chamber.

4. The method according to claim 3, further comprising the step of applying a voltage to the electro-conductive member, the electroconductive member being disposed on the surface of the substrate.

5. A method of manufacturing an electron source comprising steps of:

exposing a surface of a substrate to a sealed atmosphere, wherein an electro-conductive member, in which an electron-emitting region is to be formed, is disposed on the surface of the substrate, and wherein the sealed atmosphere is formed by a chamber;

introducing a gas containing carbon into the sealed atmosphere;

depositing carbon on the electro-conductive member disposed on the surface of the substrate; and exhausting the gas containing carbon introduced into the sealed atmosphere during heating of the chamber, after the depositing of the carbon, wherein the chamber is heated before said introducing step, to reduce moisture absorbed to a surface of the chamber, and wherein the introducing of the gas containing carbon is performed while exhausting the sealed atmosphere formed by the chamber.

6. The method according to claim 5, further comprising the step of applying a voltage to the electro-conductive member.

7. A method of manufacturing an electron source comprising steps of:

exposing a surface of a substrate to a sealed atmosphere, wherein an electro-conductive member, capable of being subjected to an activation of an electron-emitting function, is disposed on the surface of the substrate, wherein the sealed atmosphere is formed by a chamber;

introducing a gas containing carbon into the sealed atmosphere;

depositing carbon on the electro-conductive member disposed on the surface of the substrate; and exhausting the gas containing carbon introduced into the sealed atmosphere during heating of the chamber, after the depositing of the carbon, wherein the chamber is heated before said introducing step, and wherein the introducing of the gas containing carbon is performed while exhausting the sealed atmosphere formed by the chamber.

8. The method according to claim 7, further comprising the step of applying a voltage to the electro-conductive member.

* * * * *

UNITED STATES PATENT AND TRADEMARK OFFICE

CERTIFICATE OF CORRECTION

PATENT NO. : 7,021,981 B2 
APPLICATION NO. : 10/014131
DATED : April 4, 2006
INVENTOR(S) : Toshikazu Onishi et al.

It is certified that error appears in the above-identified patent and that said Letters Patent is hereby corrected as shown below:

ON COVER PAGE AT (75) INVENTORS

"Toshikazu Onishi, Kanagawa-ken (JP); Yoshikazu Banno, Tokyo (JP); Michiyo Nishimura, Kanagawa-ken (JP); Toshihiko Takeda, Kanagawa-ken (JP); Keisuke Yamamoto, Kanagawa-ken (JP); Tomoko Maruyama, Kanagawa-ken (JP)"

should read

--Toshikazu Onishi, Sagamihara (JP); Yoshikazu Banno, Tokyo (JP); Michiyo Nishimura, Sagamihara (JP); Toshihiko Takeda, Atsugi (JP); Keisuke Yamamoto, Yamato (JP); Tomoko Maruyama, Atsugi (JP)--.

COLUMN 15

Line 67, "apparatus:" should read --apparatus.--.

Signed and Sealed this

Twenty-eighth Day of November, 2006

JON W. DUDAS
*Director of the United States Patent and Trademark Office*